US011072178B1

(12) United States Patent
Kailey et al.

(10) Patent No.: US 11,072,178 B1
(45) Date of Patent: Jul. 27, 2021

(54) ADAPTIVE FLUSHING USING BIT PLANES

(71) Applicants: Walter F. Kailey, Frederick, CO (US); David Ward, Broomfield, CO (US)

(72) Inventors: Walter F. Kailey, Frederick, CO (US); David Ward, Broomfield, CO (US)

(73) Assignee: Ricoh Company, Ltd., Tokyo (JP)

( * ) Notice: Subject to any disclaimer, the term of this patent is extended or adjusted under 35 U.S.C. 154(b) by 1 day.

(21) Appl. No.: 16/800,842

(22) Filed: Feb. 25, 2020

(51) Int. Cl.
*B41J 2/165* (2006.01)

(52) U.S. Cl.
CPC ..... *B41J 2/16526* (2013.01); *B41J 2/16579* (2013.01); *B41J 2002/1657* (2013.01); *B41J 2002/16573* (2013.01); *B41J 2002/16576* (2013.01)

(58) Field of Classification Search
CPC ..... B41J 2/16526; B41J 2/16579; B41J 2002/16576; B41J 2002/16573; B41J 2002/1657
See application file for complete search history.

(56) References Cited

U.S. PATENT DOCUMENTS 8,292,390 B2 10/2012 Furuhata et al.
8,506,046 B2 8/2013 Chandu et al.
8,540,342 B2 9/2013 Kanzaki
9,889,668 B2 2/2018 Kifuku
2006/0214979 A1* 9/2006 Inoue ..... B41J 2/16585 347/22
2015/0231886 A1* 8/2015 Yamazaki ..... B41J 2/16517 347/35
2019/0389221 A1 12/2019 Ferreri et al.

FOREIGN PATENT DOCUMENTS

WO 2018080467 A1 5/2018

OTHER PUBLICATIONS

P.F. Blazdell et al; Application of a continuous ink jet printer to solid freeforming of ceramics; Elsevier Journal of Materials Processing Technology 99 (2000).

* cited by examiner

*Primary Examiner* — Sharon Polk
(74) *Attorney, Agent, or Firm* — Duft & Bornsen, PC

(57) ABSTRACT

Systems, methods, software for adaptive flushing. In one embodiment, an adaptive flushing system obtains bit plane data from a plurality of bit planes, and arranges the bit plane data into one or more pixel blocks. For a pixel block, the adaptive flushing system identifies a flush record for the pixel block that indicates a flush eligibility status for each of the pixels in the pixel block, and updates the flush record to indicate the flush eligibility status as flush-ineligible for each of the pixels in the pixel block having a jetting symbol specified in the bit planes. The adaptive flushing system selects a candidate pixel(s) from the pixel block as a candidate for flushing, and modifies the bit plane data in one or more of the bit planes to include a flush symbol at the candidate pixel when the candidate pixel has a flush eligibility status that is flush eligible.

20 Claims, 24 Drawing Sheets

FIG. 7

710 711 702 220

| | 0 | 1 | 2 | 3 | 4 | 5 | 6 | 7 | | n |
|---|---|---|---|---|---|---|---|---|---|---|
| 0 | PV (0,0) | PV (0,1) | PV (0,2) | PV (0,3) | PV (0,4) | PV (0,5) | PV (0,6) | PV (0,7) | … | PV (0,n) |
| 1 | PV (1,0) | PV (1,1) | PV (1,2) | PV (1,3) | PV (1,4) | PV (1,5) | PV (1,6) | PV (1,7) | … | PV (1,n) |
| 2 | PV (2,0) | PV (2,1) | PV (2,2) | PV (2,3) | PV (2,4) | PV (2,5) | PV (2,6) | PV (2,7) | … | PV (2,n) |
| 3 | PV (3,0) | PV (3,1) | PV (3,2) | PV (3,3) | PV (3,4) | PV (3,5) | PV (3,6) | PV (3,7) | … | PV (3,n) |
| 4 | PV (4,0) | PV (4,1) | PV (4,2) | PV (4,3) | PV (4,4) | PV (4,5) | PV (4,6) | PV (4,7) | … | PV (4,n) |
| 5 | PV (5,0) | PV (5,1) | PV (5,2) | PV (5,3) | PV (5,4) | PV (5,5) | PV (5,6) | PV (5,7) | … | PV (5,n) |
| 6 | PV (6,0) | PV (6,1) | PV (6,2) | PV (6,3) | PV (6,4) | PV (6,5) | PV (6,6) | PV (6,7) | … | PV (6,n) |
| 7 | PV (7,0) | PV (7,1) | PV (7,2) | PV (7,3) | PV (7,4) | PV (7,5) | PV (7,6) | PV (7,7) | … | PV (7,n) |
| | … | … | … | … | … | … | … | … | … | … |
| m | PV (m,0) | PV (m,1) | PV (m,2) | PV (m,3) | PV (m,4) | PV (m,5) | PV (m,6) | PV (m,7) | … | PV (m,n) |

FIG. 8

710 711 800 702 220

| | 0 | 1 | 2 | 3 | 4 | 5 | 6 | 7 | | n |
|---|---|---|---|---|---|---|---|---|---|---|
| 0 | PV (0,0) | PV (0,1) | PV (0,2) | PV (0,3) | PV (0,4) | PV (0,5) | PV (0,6) | PV (0,7) | … | PV (0,n) |
| 1 | PV (1,0) | PV (1,1) | PV (1,2) | PV (1,3) | PV (1,4) | PV (1,5) | PV (1,6) | PV (1,7) | … | PV (1,n) |
| 2 | PV (2,0) | PV (2,1) | PV (2,2) | PV (2,3) | PV (2,4) | PV (2,5) | PV (2,6) | PV (2,7) | … | PV (2,n) |
| 3 | PV (3,0) | PV (3,1) | PV (3,2) | PV (3,3) | PV (3,4) | PV (3,5) | PV (3,6) | PV (3,7) | … | PV (3,n) |
| 4 | PV (4,0) | PV (4,1) | PV (4,2) | PV (4,3) | PV (4,4) | PV (4,5) | PV (4,6) | PV (4,7) | … | PV (4,n) |
| 5 | PV (5,0) | PV (5,1) | PV (5,2) | PV (5,3) | PV (5,4) | PV (5,5) | PV (5,6) | PV (5,7) | … | PV (5,n) |
| 6 | PV (6,0) | PV (6,1) | PV (6,2) | PV (6,3) | PV (6,4) | PV (6,5) | PV (6,6) | PV (6,7) | … | PV (6,n) |
| 7 | PV (7,0) | PV (7,1) | PV (7,2) | PV (7,3) | PV (7,4) | PV (7,5) | PV (7,6) | PV (7,7) | … | PV (7,n) |
| | … | … | … | … | … | … | … | … | … | … |
| m | PV (m,0) | PV (m,1) | PV (m,2) | PV (m,3) | PV (m,4) | PV (m,5) | PV (m,6) | PV (m,7) | … | PV (m,n) |

FIG. 17

224-B

1302

| | 0 | 1 | 2 | 3 | 4 | 5 | 6 | 7 | |
|---|---|---|---|---|---|---|---|---|---|
| 0 | HOB (0,0) | HOB (0,1) | HOB (0,2) | HOB (0,3) | HOB (0,4) | HOB (0,5) | HOB (0,6) | HOB (0,7) | … |
| 1 | HOB (1,0) | HOB (1,1) | HOB (1,2) | HOB (1,3) | HOB (1,4) | HOB (1,5) | HOB (1,6) | HOB (1,7) | … |
| 2 | HOB (2,0) | HOB (2,1) | HOB (2,2) | HOB (2,3) | HOB (2,4) | HOB (2,5) | HOB (2,6) | HOB (2,7) | … |
| 3 | HOB (3,0) | HOB (3,1) | HOB (3,2) | HOB (3,3) | HOB (3,4) | HOB (3,5) | HOB (3,6) | HOB (3,7) | … |
| 4 | HOB (4,0) | HOB (4,1) | HOB (4,2) | HOB (4,3) | HOB (4,4) | HOB (4,5) | HOB (4,6) | HOB (4,7) | … |
| 5 | HOB (5,0) | HOB (5,1) | HOB (5,2) | HOB (5,3) | HOB (5,4) | HOB (5,5) | HOB (5,6) | HOB (5,7) | … |
| 6 | HOB (6,0) | HOB (6,1) | HOB (6,2) | HOB (6,3) | HOB (6,4) | HOB (6,5) | HOB (6,6) | HOB (6,7) | … |
| 7 | HOB (7,0) | HOB (7,1) | HOB (7,2) | HOB (7,3) | HOB (7,4) | HOB (7,5) | HOB (7,6) | HOB (7,7) | … |
| | … | … | … | … | … | … | … | … | … |

FIG. 18

222

PV

| | 0 | 1 | 2 | 3 | 4 | 5 | 6 | 7 | |
|---|---|---|---|---|---|---|---|---|---|
| 0 | HOB LOB | HOB LOB | HOB LOB | HOB LOB | HOB LOB | HOB LOB | HOB LOB | HOB LOB | … |
| 1 | HOB LOB | HOB LOB | HOB LOB | HOB LOB | HOB LOB | HOB LOB | HOB LOB | HOB LOB | … |
| 2 | HOB LOB | HOB LOB | HOB LOB | HOB LOB | HOB LOB | HOB LOB | HOB LOB | HOB LOB | … |
| 3 | HOB LOB | HOB LOB | HOB LOB | HOB LOB | HOB LOB | HOB LOB | HOB LOB | HOB LOB | … |
| 4 | HOB LOB | HOB LOB | HOB LOB | HOB LOB | HOB LOB | HOB LOB | HOB LOB | HOB LOB | … |
| 5 | HOB LOB | HOB LOB | HOB LOB | HOB LOB | HOB LOB | HOB LOB | HOB LOB | HOB LOB | … |
| 6 | HOB LOB | HOB LOB | HOB LOB | HOB LOB | HOB LOB | HOB LOB | HOB LOB | HOB LOB | … |
| 7 | HOB LOB | HOB LOB | HOB LOB | HOB LOB | HOB LOB | HOB LOB | HOB LOB | HOB LOB | … |
| | … | … | … | … | … | … | … | … | … |

FIG. 28

224

711

710

| BP1 | | | | | | | | | | | |
|---|---|---|---|---|---|---|---|---|---|---|---|
| 1 | 1 | 0 | 0 | 0 | 0 | 0 | 0 | 0 | 1 | 1 | 1 |
| 0 | 1 | 1 | 0 | 1 | 0 | 0 | 1 | 1 | 0 | 0 | 0 |
| 1 | 1 | 0 | 1 | 0 | 1 | 0 | 0 | 0 | 0 | 0 | 0 |
| 1 | 1 | 0 | 1 | 0 | 0 | 0 | 0 | 1 | 1 | 0 | 1 |
| 1 | 0 | 1 | 0 | 1 | 1 | 1 | 0 | 1 | 0 | 0 | 1 |
| 1 | 1 | 0 | 0 | 0 | 1 | 1 | 1 | 1 | 0 | 1 | 1 |
| 0 | 1 | 1 | 0 | 0 | 0 | 1 | 1 | 1 | 1 | 1 | 1 |
| 1 | 1 | 1 | 1 | 1 | 1 | 1 | 1 | 1 | 1 | 1 | 1 |
| 1 | 1 | 0 | 0 | 1 | 1 | 0 | 1 | 0 | 0 | 0 | 0 |
| 0 | 0 | 0 | 0 | 1 | 1 | 0 | 0 | 0 | 0 | 0 | 1 |

224-D

| BP0 | | | | | | | | | | | |
|---|---|---|---|---|---|---|---|---|---|---|---|
| 0 | 1 | 1 | 0 | 0 | 0 | 1 | 1 | 0 | 0 | 1 | 0 |
| 0 | 1 | 0 | 0 | 0 | 0 | 0 | 0 | 1 | 1 | 0 | 1 |
| 0 | 1 | 1 | 0 | 1 | 1 | 1 | 1 | 1 | 0 | 0 | 0 |
| 1 | 0 | 1 | 0 | 1 | 0 | 0 | 1 | 0 | 1 | 1 | 0 |
| 0 | 1 | 0 | 1 | 0 | 0 | 0 | 1 | 0 | 1 | 0 | 1 |
| 1 | 0 | 1 | 1 | 0 | 1 | 1 | 1 | 1 | 0 | 1 | 1 |
| 0 | 1 | 1 | 0 | 0 | 0 | 1 | 1 | 1 | 1 | 1 | 1 |
| 1 | 1 | 0 | 1 | 0 | 0 | 1 | 1 | 0 | 0 | 1 | 1 |
| 1 | 1 | 0 | 0 | 1 | 1 | 0 | 1 | 0 | 0 | 1 | 1 |
| 1 | 1 | 0 | 1 | 0 | 0 | 1 | 0 | 1 | 0 | 1 | 0 |

224-C

FIG. 29

2202-1 2202-2 2202-3

2901

2902

| BP1 | | | | | | | | | | | |
|---|---|---|---|---|---|---|---|---|---|---|---|
| 1 | 1 | 0 | 0 | 0 | 0 | 0 | 0 | 0 | 1 | 1 | 1 |
| 0 | 1 | 1 | 0 | 1 | 0 | 0 | 1 | 1 | 0 | 0 | 0 |
| 1 | 1 | 0 | 1 | 0 | 1 | 0 | 0 | 0 | 0 | 0 | 0 |
| 1 | 1 | 0 | 1 | 0 | 0 | 0 | 0 | 1 | 1 | 0 | 1 |
| 1 | 0 | 1 | 0 | 1 | 1 | 1 | 0 | 1 | 0 | 0 | 1 |
| 1 | 1 | 0 | 0 | 0 | 1 | 1 | 1 | 1 | 0 | 1 | 1 |
| 0 | 1 | 1 | 0 | 0 | 0 | 1 | 1 | 1 | 1 | 1 | 1 |
| 1 | 1 | 1 | 1 | 1 | 1 | 1 | 1 | 1 | 1 | 1 | 1 |
| 1 | 1 | 0 | 0 | 1 | 1 | 0 | 1 | 0 | 0 | 0 | 0 |
| 0 | 0 | 0 | 0 | 1 | 1 | 0 | 0 | 0 | 0 | 0 | 1 |

224-D 2202-1 2202-2 2202-3

| BP0 | | | | | | | | | | | |
|---|---|---|---|---|---|---|---|---|---|---|---|
| 0 | 1 | 1 | 0 | 0 | 0 | 1 | 1 | 0 | 0 | 1 | 0 |
| 0 | 1 | 0 | 0 | 0 | 0 | 0 | 0 | 1 | 1 | 0 | 1 |
| 0 | 1 | 1 | 0 | 1 | 1 | 1 | 1 | 1 | 0 | 0 | 0 |
| 1 | 0 | 1 | 0 | 1 | 0 | 0 | 1 | 0 | 1 | 1 | 0 |
| 0 | 1 | 0 | 1 | 0 | 0 | 0 | 1 | 0 | 1 | 0 | 1 |
| 1 | 0 | 1 | 1 | 0 | 1 | 1 | 1 | 1 | 0 | 1 | 1 |
| 0 | 1 | 1 | 0 | 0 | 0 | 1 | 1 | 1 | 1 | 1 | 1 |
| 1 | 1 | 0 | 1 | 0 | 0 | 1 | 1 | 0 | 0 | 1 | 1 |
| 1 | 1 | 0 | 0 | 1 | 1 | 0 | 1 | 0 | 0 | 1 | 1 |
| 1 | 1 | 0 | 1 | 0 | 0 | 1 | 0 | 1 | 0 | 1 | 0 |

224-C

ADAPTIVE FLUSHING USING BIT PLANES

TECHNICAL FIELD

This disclosure relates to the field of image formation, and more particularly, to flushing nozzles of printheads.

BACKGROUND

Image formation is a procedure whereby a digital image is recreated on a medium by propelling droplets of ink or another type of print fluid or recording material onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

When one or more nozzles of a printhead are idle for a period of time, the recording material (e.g., ink) can begin to dry or coagulate. This can clog the nozzle and decrease print quality. To ensure that the recording material does not dry in the nozzle, the nozzles may be periodically flushed on non-used portions of the medium, or within portions of the medium marked with print data. The recording material that is flushed is considered waste, so it is desirable to perform flushing operations efficiently.

SUMMARY

Provided herein are an adaptive flushing system, method, and software that perform flushing operations on bit planes. As an overview, adaptive flushing ensures that each nozzle of a printhead(s) jets at least once within a given flush period (e.g., a certain number of print lines where print lines occur at a known time frequency). Nozzles that jet within the flush period based on the print data are inhibited from flushing. The adaptive flushing system processes bit planes that, in combination, define a digital image for printing by the printhead(s). For example, a two-bit output is comprised of two bit planes: one for the low-order bit (or least significant bit), and one for the higher-order bit (or most significant bit) of each pixel of the digital image. By processing the bit planes, the adaptive flushing system is able to determine which nozzles are flushed and which nozzles are inhibited from flushing. The technical benefits of the adaptive flushing described herein are that recording material is conserved, and image quality is improved.

One embodiment comprises an adaptive flushing system that includes a processor, and memory including computer program code executable by the processor. The processor causes the adaptive flushing system to obtain bit plane data from a plurality of bit planes that in combination define pixel values for an array of pixels. The bit plane data comprises bits from each of the bit planes for a row of the pixels. The processor causes the adaptive flushing system to arrange the bit plane data into one or more pixel blocks. For each pixel block of the pixel blocks, the processor causes the adaptive flushing system to identify a flush record for the pixel block that indicates a flush eligibility status for each of the pixels in the pixel block, update the flush record to indicate the flush eligibility status as flush-ineligible for each of the pixels in the pixel block having a jetting symbol specified in the bit planes, select at least one candidate pixel from the pixel block as a candidate for flushing, and modify the bit plane data in at least one of the bit planes to include a flush symbol at the candidate pixel when the candidate pixel has a flush eligibility status that is flush eligible. The processor further causes the adaptive flushing system to output the bit plane data for the bit planes.

Other illustrative embodiments (e.g., methods and computer-readable media relating to the foregoing embodiments) may be described below. The features, functions, and advantages that have been discussed can be achieved independently in various embodiments or may be combined in yet other embodiments further details of which can be seen with reference to the following description and drawings.

DESCRIPTION OF THE DRAWINGS

Some embodiments of the present disclosure are now described, by way of example only, and with reference to the accompanying drawings. The same reference number represents the same element or the same type of element on all drawings.

FIG. 7 illustrates a raster image that includes an array of pixels arranged in rows and columns.

FIG. 8 illustrates a block of pixels in a raster image in an illustrative embodiment.

FIGS. 16-17 illustrate bit planes that define pixel values for a halftoned image in an illustrative embodiment.

FIG. 18 illustrates a halftoned image with bit planes merged in an illustrative embodiment.

FIG. 28 illustrates bit planes in an illustrative embodiment.

FIG. 29 illustrates pixel blocks in bit planes in an illustrative embodiment.

DETAILED DESCRIPTION

The figures and the following description illustrate specific illustrative embodiments of the disclosure. It will thus be appreciated that those skilled in the art will be able to devise various arrangements that, although not explicitly described or shown herein, embody the principles of the disclosure and are included within the scope of the disclosure. Furthermore, any examples described herein are intended to aid in understanding the principles of the disclosure, and are to be construed as being without limitation to such specifically recited examples and conditions. As a result, the disclosure is not limited to the specific embodiments or examples described below, but by the claims and their equivalents.

Figure 1:
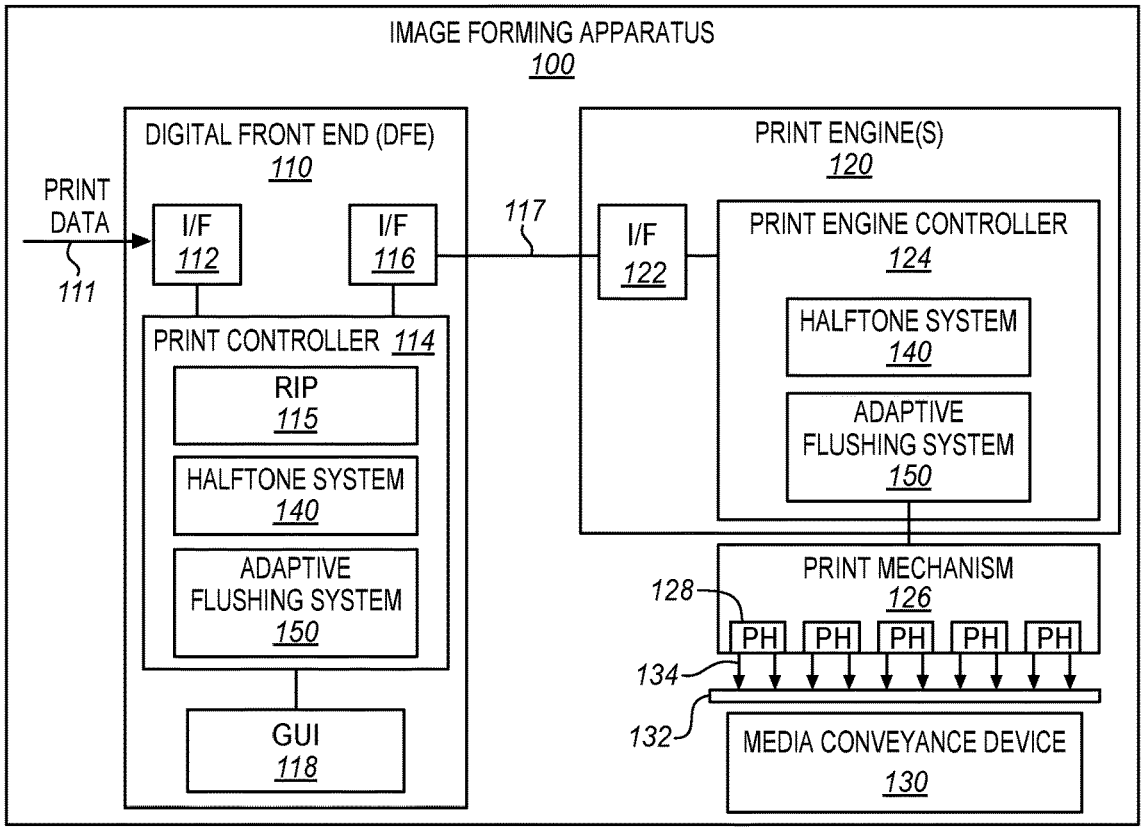
FIG. 1 is a schematic diagram of an image forming apparatus in an illustrative embodiment.

FIG. 1 is a schematic diagram of an image forming apparatus 100 in an illustrative embodiment. Image forming apparatus 100 is a type of device that executes an image forming process (e.g., printing) on a recording medium 132. Image forming apparatus 100 may comprise a continuous-feed printer that prints on a web of media, such as paper. Although a continuous-feed printer is discussed, concepts described herein may also apply to alternative print systems, such as cut-sheet printers, wide format printers, 3D printers, etc.

In this embodiment, image forming apparatus 100 includes a Digital Front End (DFE) 110, one or more print engines 120, and a media conveyance device 130. DFE 110 comprises a device, circuitry, and/or other component configured to accept print data 111, and convert the print data 111 into a suitable format for print engine 120. DFE 110 includes an Input/Output (I/O) interface 112, a print controller 114, a print engine interface 116, and a Graphical User Interface (GUI) 118. I/O interface 112 comprises a device, circuitry, and/or other component configured to receive print data 111 from a source. For example, I/O interface 112 may receive the print data 111 from a host system (not shown), such as a personal computer, a server, etc., over a network connection, may receive print data 111 from an external memory, etc. Thus, I/O interface 112 may be considered a network interface in some embodiments. The print data 111 comprises a file, document, print job, etc., that is formatted with a Page Description Language (PDL), such as PostScript, Printer Command Language (PCL), Intelligent Printer Data Stream (IPDS), etc. Print controller 114 comprises a device, circuitry, and/or other component configured to transform the print data 111 into one or more digital images that may be used by print engine 120 to mark a recording medium 132 with ink or another marking/recording material. Thus, print controller 114 includes a Raster Image Processor (RIP) 115 that rasterizes the print data 111 to generate digital images. A digital image comprises a two-dimensional array of pixels. Whereas the print data 111 in PDL format is a high-level description of the content (e.g., text, graphics, pictures, etc.), a digital image defines a pixel value or color value for each pixel in a display space. Print engine interface 116 comprises a device, circuitry, and/or other component configured to communicate with print engine 120, such as to transmit digital images to print engine 120. Print engine interface 116 is communicatively coupled to print engine 120 via a communication link 117 (e.g., a fiber link, a bus, etc.), and is configured to use a data transfer protocol to transfer the digital images to print engine 120. GUI 118 is a hardware component configured to interact with a human operator. GUI 118 may include a display, screen, touch screen, or the like (e.g., a Liquid Crystal Display (LCD), a Light Emitting Diode (LED) display, etc.). GUI 118 may include a keyboard or keypad, a tracking device (e.g., a trackball or trackpad), a speaker, a microphone, etc. A human operator may access GUI 118 to view status indicators, view or manipulate settings, schedule print jobs, etc.

Print engine 120 includes a DFE interface 122, a print engine controller 124, and a print mechanism 126. DFE interface 122 comprises a device, circuitry, and/or other component configured to interact with DFE 110, such as to receive digital images from DFE 110. Print engine controller 124 comprises a device, circuitry, and/or other component configured to process the digital images received from DFE 110, and provide control signals to print mechanism 126. Print mechanism 126 is a device or devices that mark the recording medium 132 with a recording material 134, such as ink. Print mechanism 126 may be configured for variable droplet or dot size to reproduce multiple intensity levels, as opposed to a bi-level mechanism where a pixel is either "on" or "off". For example, multiple intensity levels per pixel may be achieved by printing one, two, or several droplets at the same position, or varying the size of a droplet. Recording medium 132 comprises any type of material suitable for printing upon which recording material 134 is applied, such as paper (web or cut-sheet), plastic, card stock, transparent sheets, a substrate for 3D printing, cloth, etc. Print mechanism 126 includes one or more printheads (PH) 128 that are configured to jet or eject droplets of recording material 134, such as ink (e.g., water, solvent, oil, or UV-curable), through a plurality of orifices or nozzles. The orifices or nozzles may be grouped according to ink types (e.g., colors such as Cyan (C), Magenta (M), Yellow (Y), Key black (K) or formulas such as for pre-coat, image and protector coat), which may be referred to as color planes. Media conveyance device 130 is configured to move recording medium 132 relative to print mechanism 126. In other embodiments, portions of print mechanism 126 may be configured to move relative to recording medium 132.

Image forming apparatus 100 may include various other components not specifically illustrated in FIG. 1.

When RIP 115 rasterizes the print data 111, the output may be a digital continuous tone image where individual pixels are defined with pixel values that are relatively large.

For example, the digital continuous tone image may have 8-bit pixel values or larger. A digital continuous tone image generated by RIP 115 is referred to herein as a "raster image". An 8-bit pixel value may represent 256 different intensities of a color. However, a typical print mechanism (e.g., print mechanism 126) may not be capable of reproduction at 256 different levels. Thus, a halftoning process may be performed to define the individual pixels with lower multi-bit values, such as two-bits, three-bits, etc. FIG. 1 also illustrates a halftone system 140 implemented in print controller 114. Halftone system 140 comprises circuitry, logic, hardware, and/or other components configured to perform a multi-level halftoning process on one or more raster images, which is described in further detail below. Although halftone system 140 is shown as being implemented in print controller 114 of DFE 110, halftone system 140 may be implemented in print engine controller 124 (as shown in FIG. 1), in a host system or another system coupled to image forming apparatus 100, or in other systems.

FIG. 1 also illustrates an adaptive flushing system 150 implemented in print controller 114. Adaptive flushing system 150 comprises circuitry, logic, hardware, and/or other components configured to perform adaptive flushing of printheads 128. Flushing is a process of jetting recording material 134 from one or more nozzles of a printhead 128 to prevent clogging of the nozzle(s). Flushing may be done between sheetsides (i.e., line flushing), or within a sheetside (i.e., star flushing). With line flushing, for example, nozzles of a printhead 128 may jet at page boundaries (e.g., top or bottom page margin) outside the printed image. With star flushing, selected nozzles of a printhead 128 jet small dots or "stars" that are scattered throughout a page and comingled with a printed image. Adaptive flushing (line flushing, star flushing, etc.) is a process where certain nozzles are flushed when they haven't jetted (e.g., instructed to jet) within a flush period, while others are not. For example, nozzles of a printhead 128 that recently jetted based on a digital image being printed may not need to be flushed, while other nozzles of the printhead 128 that did not recently jet based on the digital image may be flushed. Adaptive flushing therefore reduces usage of the recording material 134 by eliminating unneeded flushing of nozzles. Although adaptive flushing system 150 is shown as being implemented in print controller 114 of DFE 110, adaptive flushing system 150 may be implemented in print engine controller 124 (as shown in FIG. 1), in a host system or another system coupled to image forming apparatus 100, or in other systems.

Figure 2:
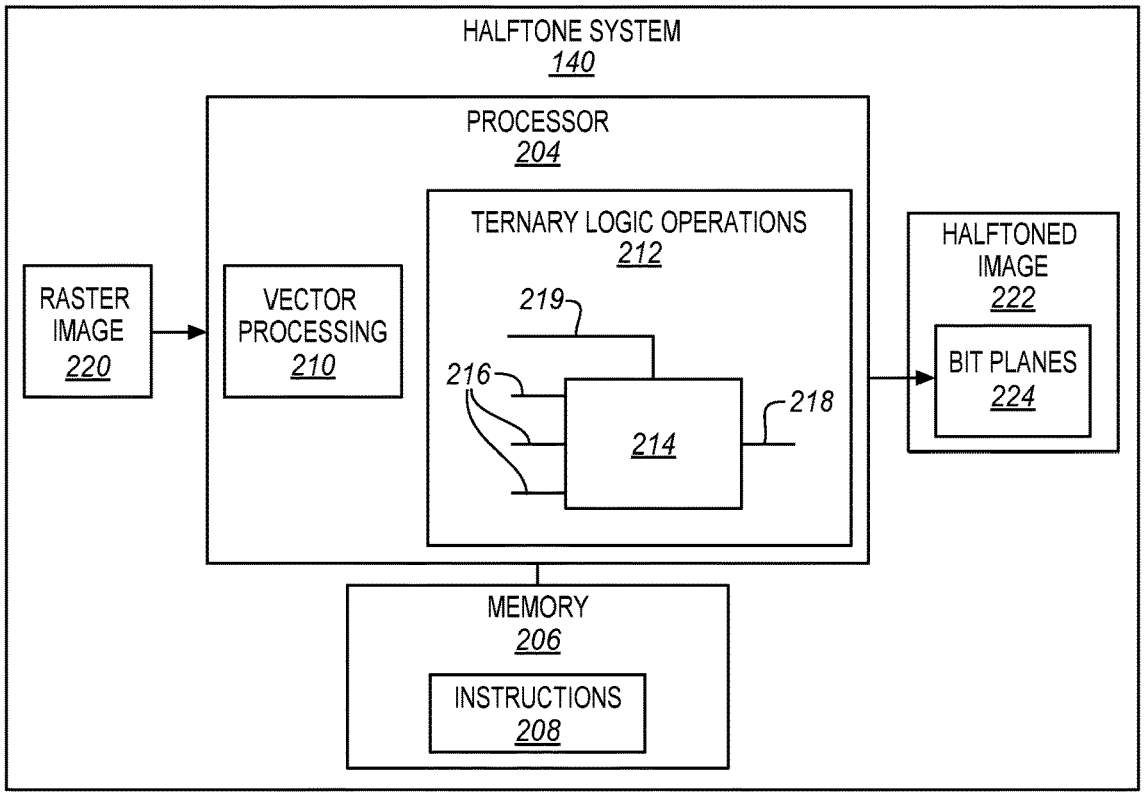
FIG. 2 is a schematic diagram of a halftone system in an illustrative embodiment.

FIG. 2 is a schematic diagram of halftone system 140 in an illustrative embodiment. Halftone system 140 includes one or more processors 204 and a memory 206. Processor 204 represents the internal circuitry, logic, hardware, etc., that provides the functions of halftone system 140. Processor 204 may be configured to execute instructions 208 (i.e., computer program code) for software that are loaded into memory 206. Processor 204 may comprise a set of one or more processors or may comprise a multi-processor core, depending on the particular implementation. Memory 206 is a computer readable storage medium for data, instructions 208, applications, etc., and is accessible by processor 204. Memory 206 is a hardware storage device capable of storing information on a temporary basis and/or a permanent basis. Memory 206 may comprise volatile or non-volatile Random-Access Memory (RAM), Read-Only Memory (ROM), FLASH devices, volatile or non-volatile Static RAM (SRAM) devices, magnetic disk drives, Solid State Disks (SSDs), or any other volatile or non-volatile storage device.

Figure 3:
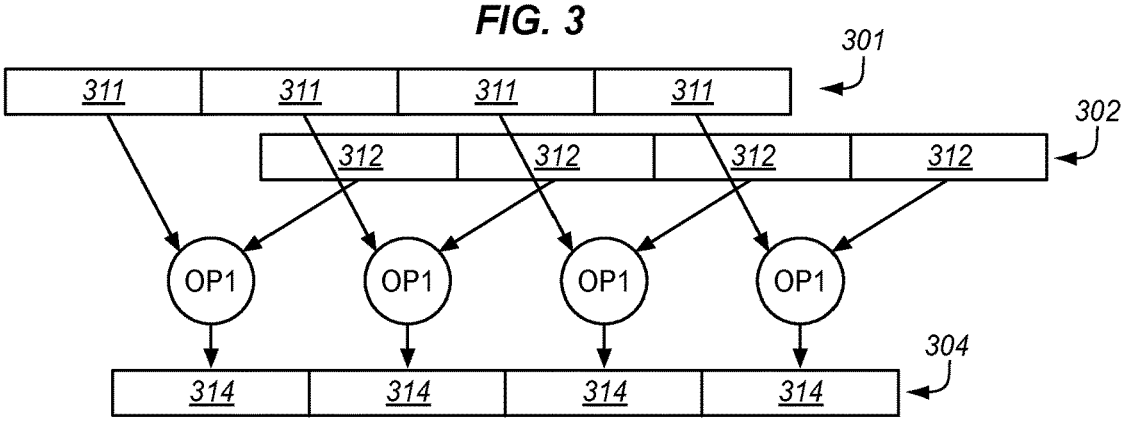
FIG. 3 illustrates a vector processing operation.

Processor 204 is configured for vector processing 210. Vector processing 210 is a type of processing that operates on sets of values called "vectors" at a time, as compared to operating on a single value. FIG. 3 illustrates a vector processing operation. Processor 204, for example, receives two vectors 301-302 as input; each one with a set of operands. Vector 301 includes a set of operands 311, and vector 302 includes a set of operands 312. Processor 204 is able to perform the same operation (OP1) on both sets of operands 311 and 312 (one operand from each vector) at a time, and outputs a vector 304 with the results 314. Processor 204 may have a variety of architectures that allow for vector processing 210, such as a Central Processing Unit (CPU) or a Graphics Processing Unit (GPU) that use a Single Instruction Multiple Data (SIMD) paradigm. In a SIMD paradigm, a single instruction is executed in parallel on multiple data points.

Figure 4:
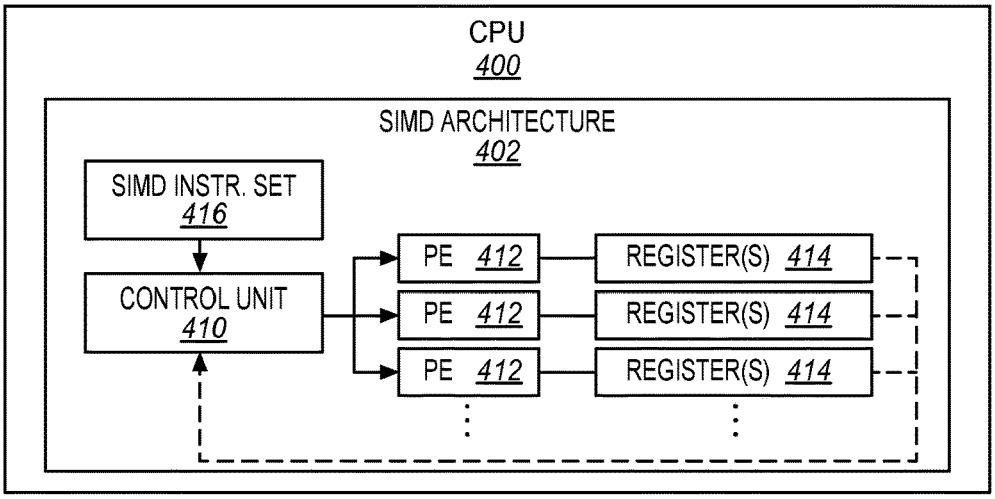
FIGS. 4-5 illustrate a CPU and a GPU that perform SIMD operations.
Figure 5:
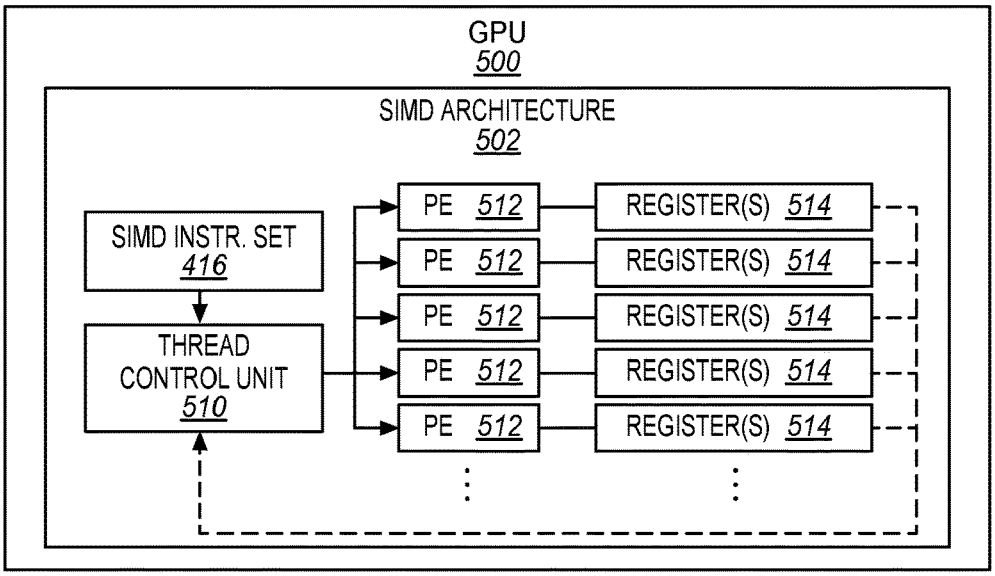

FIGS. 4-5 illustrate a CPU 400 and a GPU 500, respectively, that perform SIMD operations. CPU 400 includes a SIMD architecture 402, which includes a control unit 410, and one or more processing clusters that include multiple processing elements (PE) 412 (e.g., Arithmetic Logic Units (ALUs)) and corresponding registers 414 (also referred to as memory modules (MM)). Although three processing elements 412 are illustrated in this example, more or less processing elements may be used in other examples. Control unit 410 is configured to fetch or retrieve a SIMD instruction set 416, and issue instructions to the PEs 412 from the instruction set 416 for a clock cycle. Control unit 410 is also configured to manage data fetching, and data storage. PEs 412 represent the computational resources that perform operations based on instructions from control unit 410. Registers 414 are configured to temporarily store data for operations performed by PEs 412. For example, registers 414 may be 64-bits wide, 128-bits wide, 256-bits wide, 512-bits wide, etc. Control unit 410 may also manage processes for loading data into registers 414. GPU 500 (see FIG. 5) includes a SIMD architecture 502, which includes a thread control unit 510, and one or more processing clusters that include multiple PEs 512 and corresponding registers 514. It is noted that FIGS. 4-5 illustrate a basic structure of a CPU 400 and a GPU 500 for SIMD operations, and other structures are considered herein.

In FIG. 2, processor 204 is also configured for ternary logic operations 212. Ternary logic is a function which maps three input Boolean values (or "bits") to a single output bit. Processor 204 may include a ternary logic subsystem 214 that includes three inputs 216 and one output 218. Ternary logic subsystem 214 may be configured to perform a plurality of ternary logic functions. For example, there may be 256 ($2^8$) possible ternary logic functions defined. To select between the ternary logic functions, ternary logic subsystem 214 further includes a selector parameter 219 (e.g., an 8-bit code) that is used to select a desired ternary logic function for a given set of inputs 216. CPU 400 and/or GPU 500 as discussed above may provide machine level instructions to implement ternary logic in this manner.

As a general overview of a multi-level halftoning process, halftone system 140 receives a raster image 220 as input, and converts the raster image 220 to a multi-bit halftoned image 222 that indicates pixel values with fewer bits than the raster image 220. Halftone system 140 iterates over one or more blocks of pixels from the raster image 220 for a color plane to compare sets of pixel values from the raster image 220 to thresholds that are defined to distinguish the different intensity levels. A comparison of a set of pixel values with a threshold results in a corresponding set of comparison bits.

Ternary logic operations 212 are then performed on the comparison bits to generate bit planes 224 for the pixels. Each bit plane 224 represents one of the bits for the pixels. For example, a first bit plane represents the low-order bits of the pixels, a second bit plane represents higher-order bits of the pixels, etc. The bit planes 224, in combination, represent the multi-bit halftoned image 222.

Figure 6A:
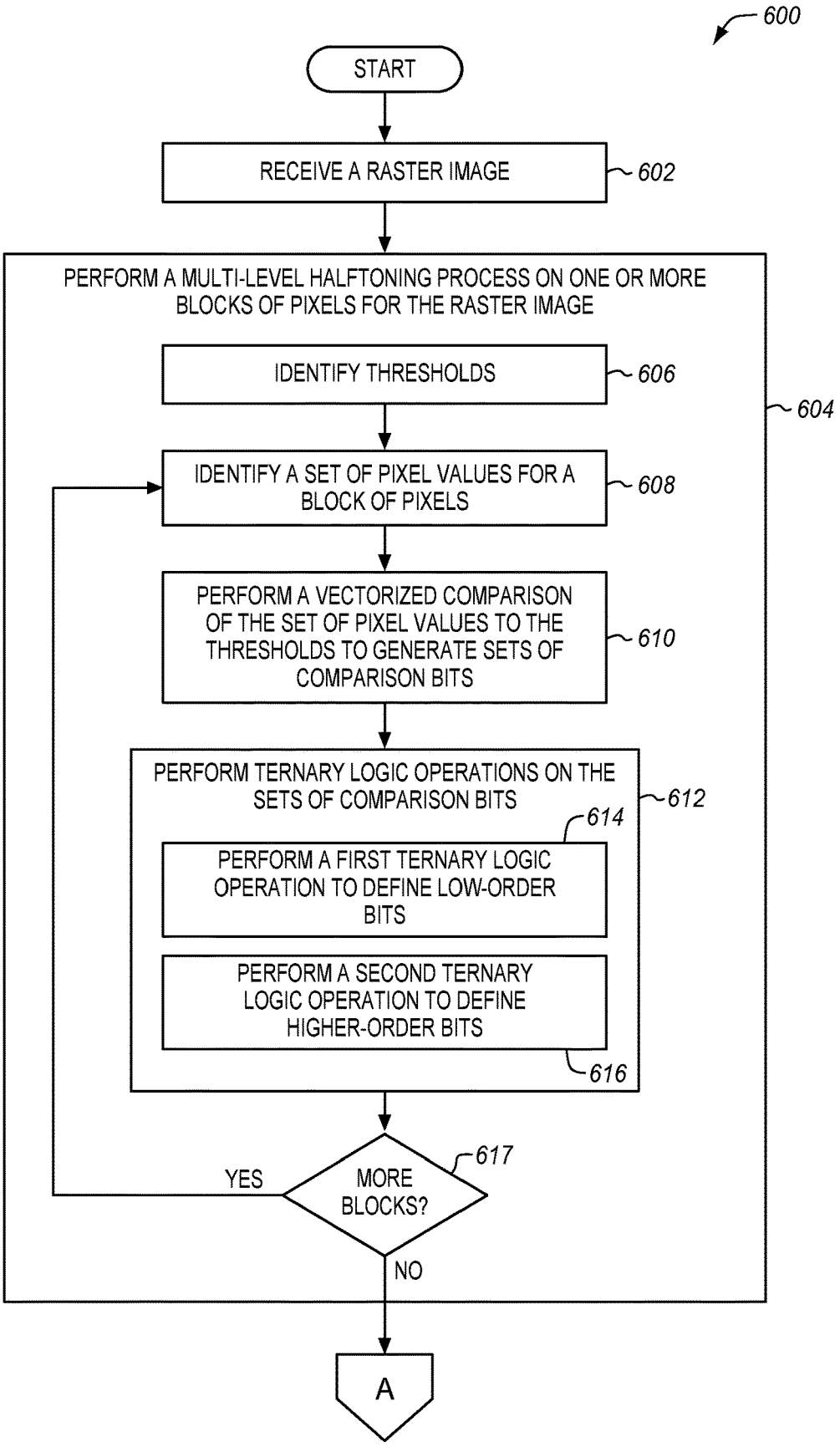
FIGS. 6A-6B depict a flowchart illustrating a method of halftoning in an illustrative embodiment.
Figure 6B:
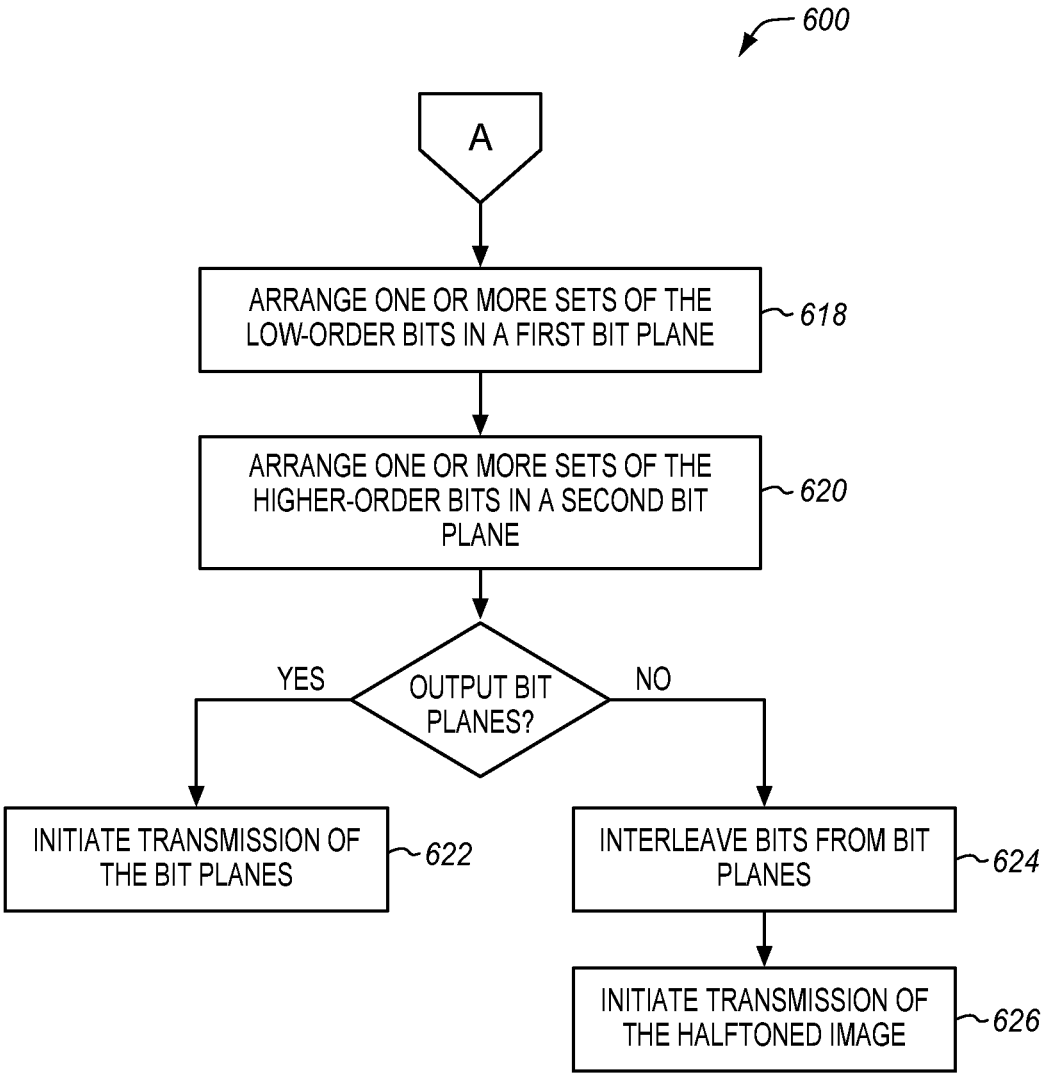

FIGS. 6A-6B depict a flowchart illustrating a method 600 of halftoning in an illustrative embodiment. The steps of method 600 are described with reference to halftone system 140 in FIG. 2, but those skilled in the art will appreciate that method 600 may be performed with other systems. The steps of the flowcharts described herein are not all inclusive and may include other steps not shown. The steps described herein may also be performed in an alternative order.

In FIG. 6A, processor 204 receives a raster image 220 (step 602) for a color plane, such as generated by RIP 115. FIG. 7 illustrates a raster image 220. Raster image 220 is a data structure that represents an array of pixels 702 with multi-bit pixel values (PV). The pixels are arranged in rows 710 and columns 711. There are "m+1" number of rows 710, and "n+1" number of columns 711. For illustrative purposes, each pixel 702 is noted with a (row,column) identifier (e.g., "(0,0)"). Each pixel 702 has an associated pixel value PV that is defined by x-bits, such as 8-bits, 16-bits, etc. For example, if the pixel values are 8-bit, then each pixel 702 may have any value between 0-255 (decimal). Raster image 220 is for a single color plane, such as Cyan (C), Magenta (M), Yellow (Y), or Key black (K).

In FIG. 6A, processor 204 performs a multi-level halftoning process on one or more blocks of pixels 702 for raster image 220 (step 604). A multi-level halftoning process produces output that defines pixel values in multiple bits, as opposed to a bi-level halftoning process. For example, a multi-level halftoning process may produce pixel values that are two-bits, three-bits, etc. Processor 204 may identify thresholds for multi-level reproduction (step 606). Multi-level reproduction involves multiple intensity levels, and therefore multiple thresholds that distinguish the different intensity levels. There is one less threshold than number of intensity levels. For example, a pixel represented by two bits may have four intensity levels (e.g., 00, 01, 10, 11). In this two-bit example with four intensity levels, there are three thresholds that distinguish or divide the four intensity levels. Thus, processor 204 may identify a first threshold, a second threshold, and a third threshold, such as by retrieving these thresholds from memory 206. In a two-bit example with three intensity levels, there are two thresholds that distinguish or divide the three intensity levels. In a three-bit example with eight intensity levels, there may be seven thresholds that distinguish the eight intensity levels. Processor 204 identifies the thresholds in "sets" to accommodate vector processing as described below.

Figure 9:
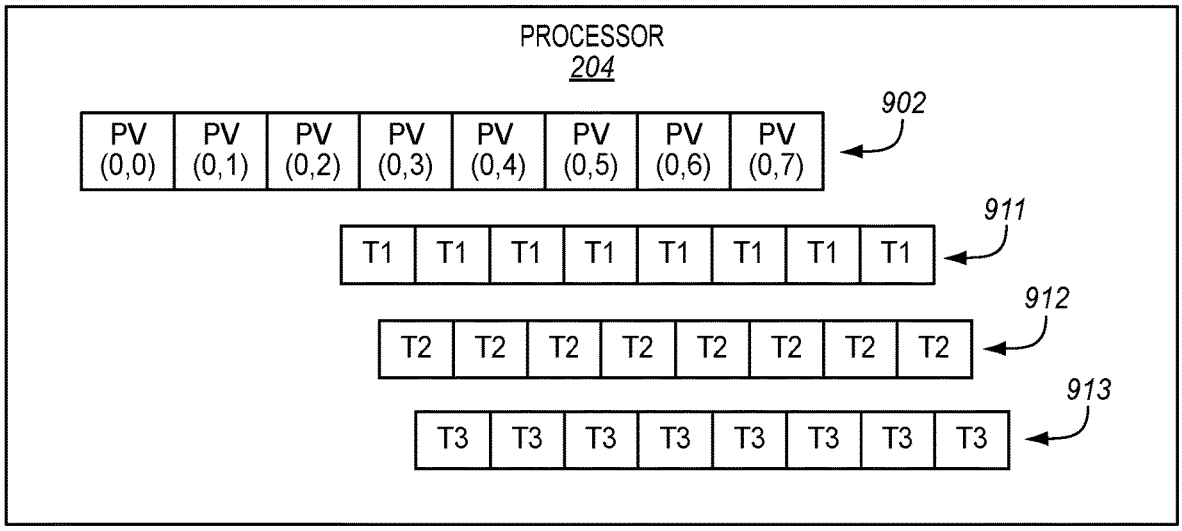
FIG. 9 is a schematic diagram of a processor with a set of pixel values for a block loaded in a local memory in an illustrative embodiment.

For the multi-level halftoning process, halftone system 140 may operate on one or more blocks of pixels at a time. Thus, processor 204 may identify a set of pixel values (PV) for pixels 702 in a block (step 608). A block of pixels 702 comprises a grouping or number of pixels that are processed at a time. A block may be a number of pixels consecutive in a row 710 of raster image 220, a number of pixels that wrap around from one row 710 to another, or another desired grouping of pixels. FIG. 8 illustrates a block 800 of pixels 702 in raster image 220 in an illustrative embodiment. In this example, block 800 includes eight pixels 702 in a single row. But as explained above, block 800 may have other numbers or groupings of pixels in other examples. Processor 204 may load the set of pixel values for block 800 in a register, a local memory, or other memory location. FIG. 9 is a schematic diagram of processor 204 with the set 902 of pixel values for block 800 loaded in a local memory in an illustrative embodiment.

Figure 10:
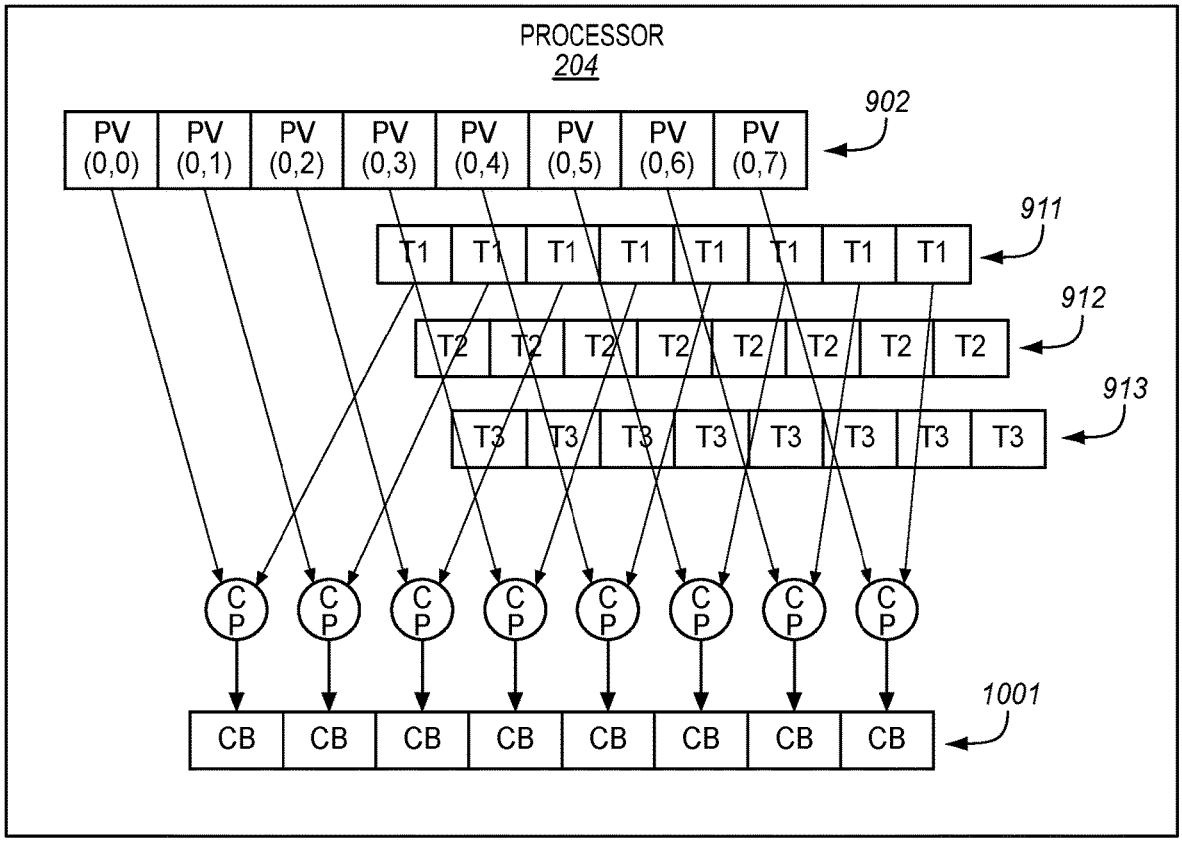
FIGS. 10-12 illustrate a vectorized comparison in an illustrative embodiment.
Figure 11:
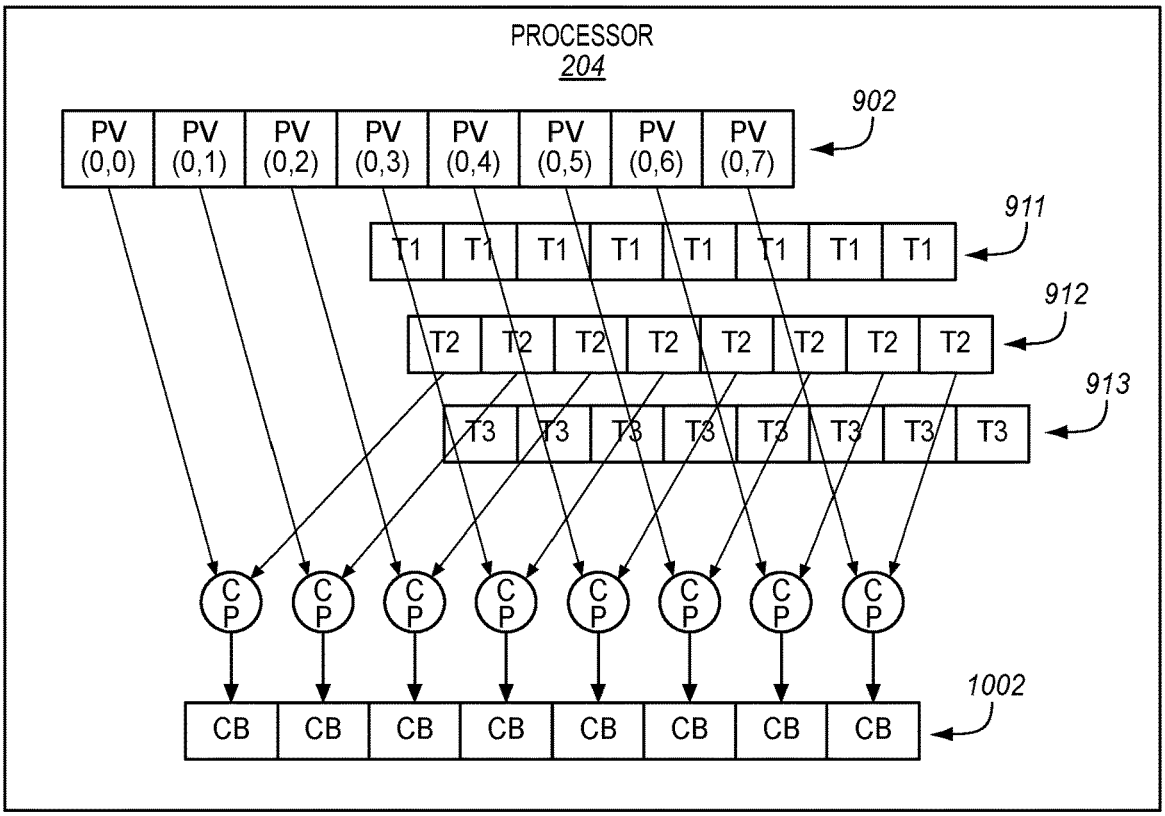
Figure 12:
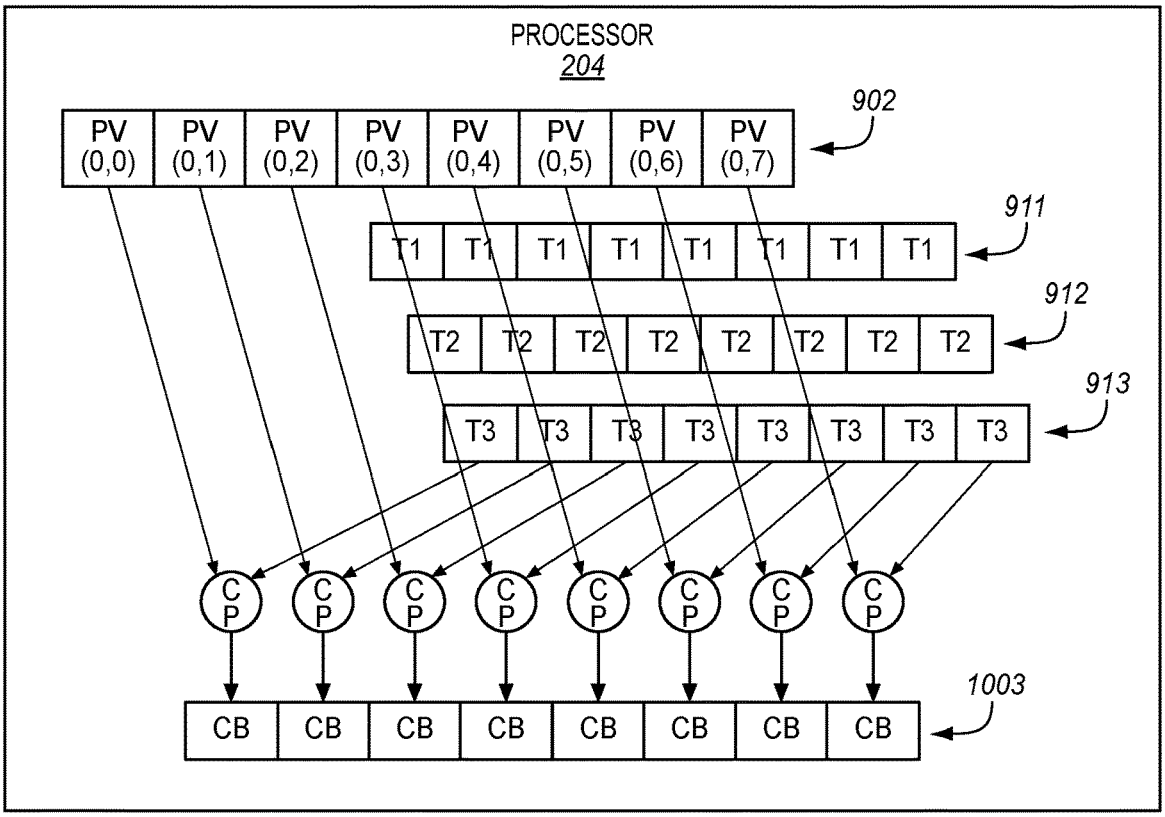

FIG. 9 further illustrates a set 911 of first thresholds (T1), a set 912 of second thresholds (T2), and a set 913 of third thresholds (T3) loaded in a local memory. In this example, the set 911 of first thresholds (T1) is used to distinguish a first intensity level and a second intensity level. The set 912 of second thresholds (T2) is used to distinguish the second intensity level and a third intensity level. The set 913 of third thresholds (T3) is used to distinguish the third intensity level and a fourth intensity level. Additional sets of thresholds may be loaded into processor 204 in cases of more than four intensity levels. In FIG. 6A, processor 204 performs a vectorized comparison of the set 902 of pixel values (PV) to the thresholds, such as in sets 911-913 (step 610). A vectorized comparison means that the set 902 of pixel values (PV) is compared to a set 911-913 of thresholds at a time (e.g., a clock cycle). The set 902 of pixel values (PV) and a set 911-913 of thresholds may be considered "vectors" where the same comparison operation is performed on both sets of values (one from each vector) at a time. It is also noted that the set 902 of pixel values (PV) may be compared to each set 911-913 of thresholds simultaneously depending on the capability of processor 204. FIGS. 10-12 illustrate a vectorized comparison in an illustrative embodiment. In FIG. 10, processor 204 performs the vectorized comparison of the set 902 of pixel values (PV) to the set 911 of first thresholds to generate a first set 1001 of comparison bits (CB). A set of comparison bits represents the result of the comparison for each pixel value and threshold. For example, if a pixel value is "220" and the threshold is "64", then the comparison bit for that pixel may be "1". If the pixel value is "50" and the threshold is "64", then the comparison bit for that pixel may be "0". Thus, a set of comparison bits corresponds with one of the thresholds and indicates the pixel values that exceed the threshold. In one embodiment, the first threshold may be for a first or smallest droplet/dot size, which means that a pixel value that exceeds the first threshold corresponds with at least the smallest droplet/dot size (i.e., the smallest droplet/dot size or a larger drop size).

In FIG. 11, processor 204 performs the vectorized comparison of the set 902 of pixel values (PV) to the set 912 of second thresholds to generate a second set 1002 of comparison bits (CB). In one embodiment, the second threshold may be for a second droplet/dot size that is larger than the first droplet/dot size, meaning that a pixel value that exceeds the second threshold corresponds with at least the second droplet/dot size (i.e., the second droplet/dot size or larger). In FIG. 12, processor 204 performs the vectorized comparison of the set 902 of pixel values (PV) to the set 913 of third thresholds to generate a third set 1003 of comparison bits (CB). In one embodiment, the third threshold may be for a third droplet/dot size that is larger than the second droplet/dot size, meaning that a pixel value that exceeds the third threshold corresponds with at least the third droplet/dot size (i.e., the third droplet/dot size or larger). Although the vectorized comparisons for the thresholds are shown in different figures, it is understood that the vectorized comparisons may be performed simultaneously within processor 204. Also, although vectorized comparisons are shown for three thresholds, processor 204 may perform vectorized comparisons for more or less thresholds depending on the number of intensity levels considered for the multi-level halftoning.

In FIG. 6A, the vectorized comparisons from step 610 result in multiple sets of comparison bits (e.g., sets 1001-1003). For multi-level halftoning, there are three or more sets of comparison bits whenever four or more output levels are used. Processor 204 performs ternary logic operations on the sets 1001-1003 of comparison bits (step 612). Ternary logic produces one output bit per three input bits. Thus, each one of the ternary logic operations outputs one bit of a pixel value for the halftoned image 222. For example, processor 204 may perform a first ternary logic operation (step 614) to define a low-order bit (least significant bit) of a pixel value, and a second ternary logic operation (step 616) to define the next higher-order bit of the pixel value. These ternary logic operations are performed to define the low-order bits and the higher-order bits for the pixels 702 in block 800.

Figure 13:
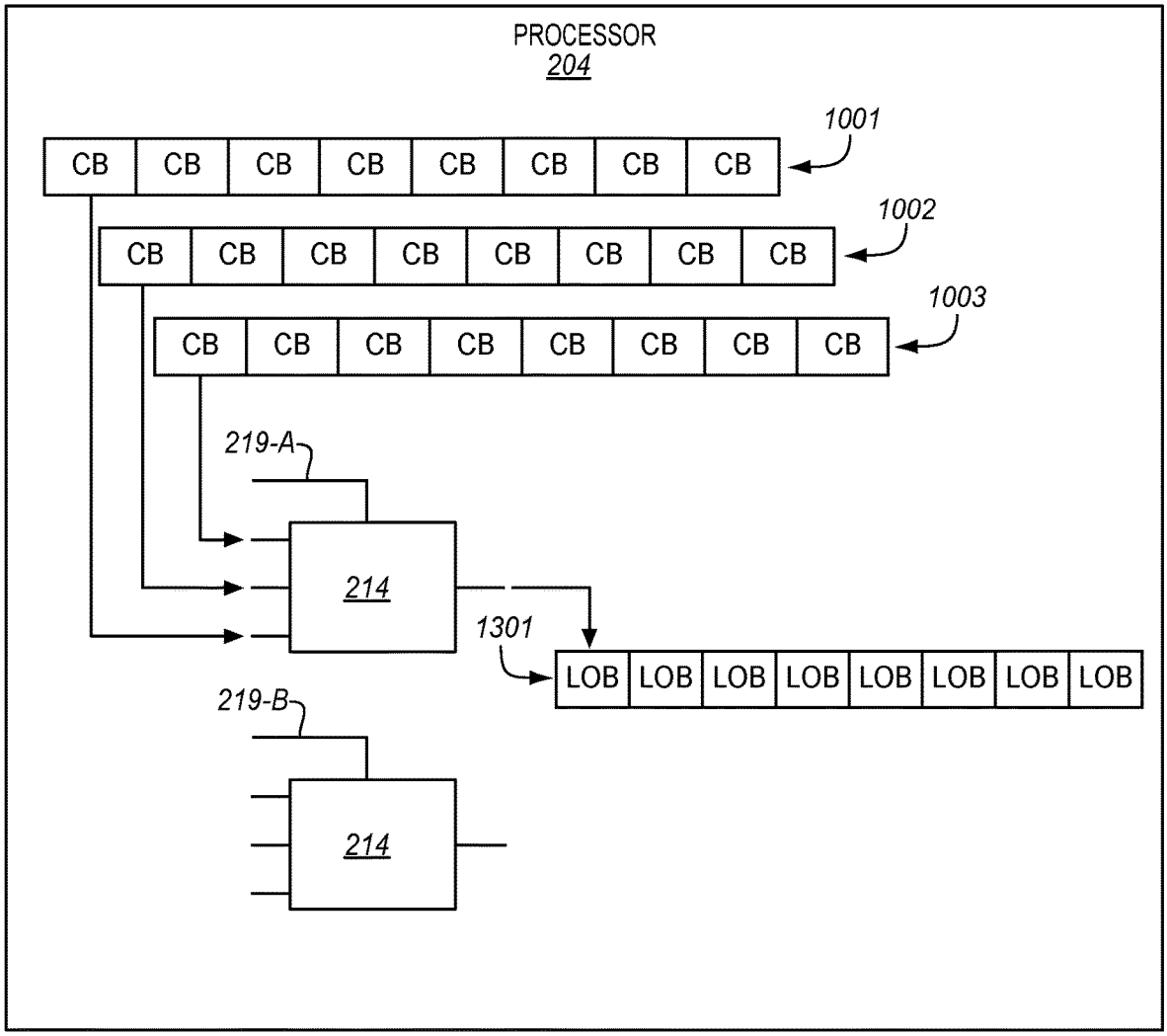
FIGS. 13-14 illustrate ternary logic operations in an illustrative embodiment.
Figure 14:
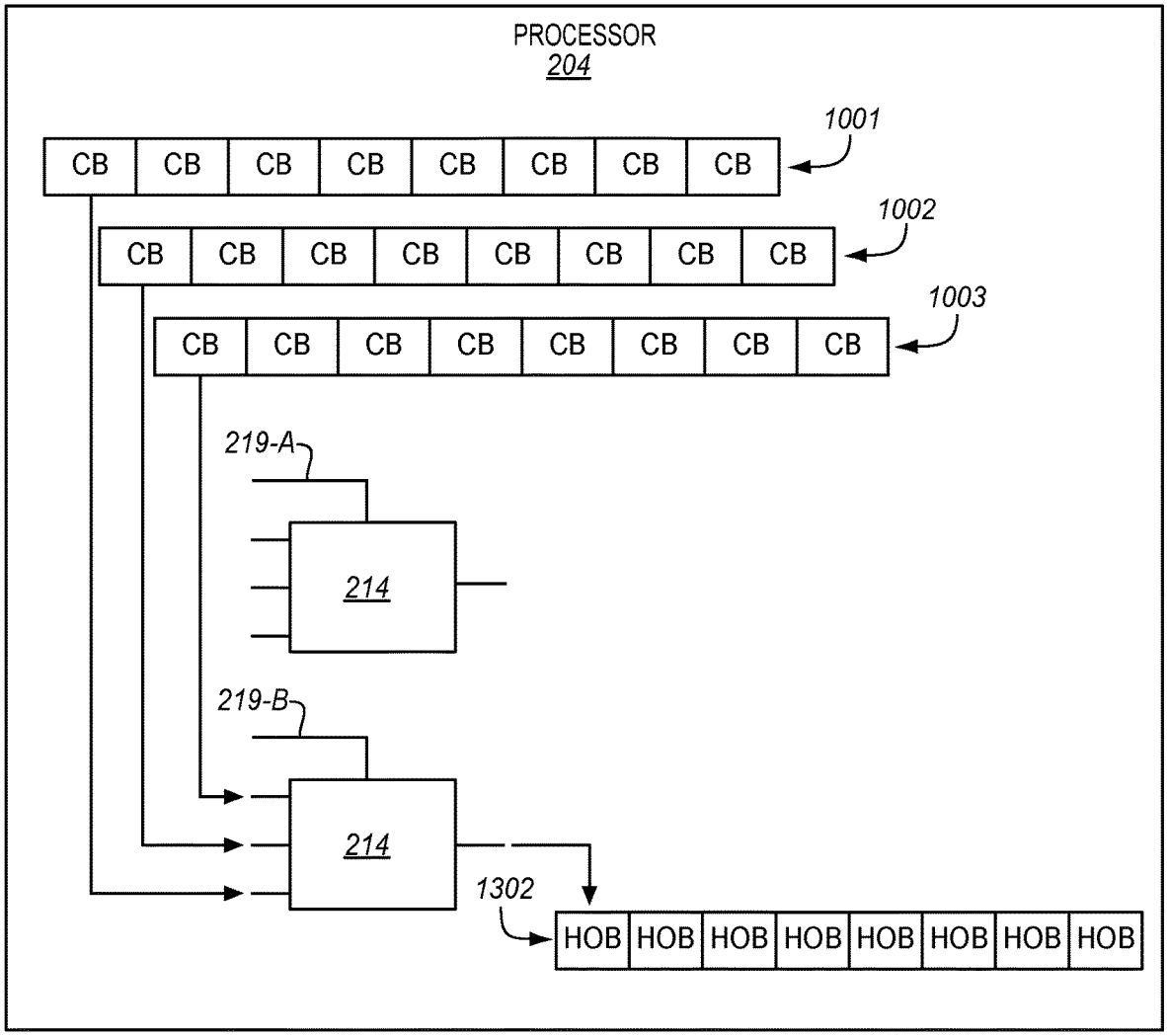

FIGS. 13-14 illustrate ternary logic operations in an illustrative embodiment. In FIG. 13, processor 204 performs a first ternary logic operation with the first set 1001 of comparison bits, the second set 1002 of comparison bits, and the third set 1003 of comparison bits as input. The first ternary logic operation outputs a set 1301 of low-order bits (LOB) for the block 800 of the pixels 702. In FIG. 14, processor 204 performs a second ternary logic operation with the first set 1001 of comparison bits, the second set 1002 of comparison bits, and the third set 1003 of comparison bits as input. The second ternary logic operation outputs a set 1302 of higher-order bits (HOB) for the block 800 of the pixels 702. For a two-bit halftoning process, the set 1302 of higher-order bits (HOB) represents the most-significant bits of the pixel values. Although not explicitly shown in FIGS. 13-14, processor 204 may perform a ternary logic operation on each of the comparison bits in sets 1001-1003 at the same time (e.g., same clock cycle). Also, although the ternary logic operations are shown in different figures, it is understood that the ternary logic operations may be performed simultaneously within processor 204.

Figure 15:
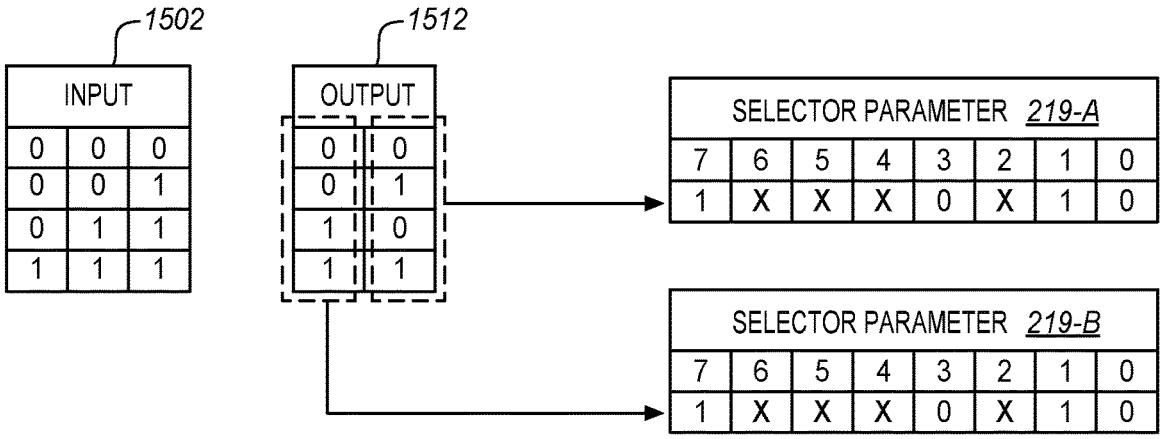
FIG. 15 illustrates computing of selector parameters in an illustrative embodiment.

As stated above, there may be 256 possible ternary logic functions defined for ternary logic subsystems 214. The selector parameters 219-A/219-B are computed for ternary logic subsystems 214 to select the desired ternary logic functions for each bit plane. A selector parameter may be thought of as a lookup table. The three input bits form a number i between zero and seven. The $i^{th}$ bit of the selector parameter gives the output bit for the case of input i. FIG. 15 illustrates computing of selector parameters 219-A/219-B in an illustrative embodiment. The input table 1502 represents comparison bits arranged from right to left, such as from sets 1001-1003. The comparison bits resulting from the smallest threshold are on the right, and comparison bits resulting from the largest threshold are on the left. These bits are interpreted as a binary number between zero and seven. Not all numbers between zero and seven are needed for well-designed halftone threshold arrays, since the thresholds for smaller droplets/dots are always exceeded when the threshold for larger droplets/dots is exceeded. Accordingly, if there are four intensity levels, then the values that appear in input table 1502 are zero, one, three, and seven (i.e., "000", "001", "011", and "111"). Output table 1512 indicates the pixel value or pixel symbol desired when the input bits are as shown in input table 1502. For example, an input of "000" may be mapped to a pixel value of "00", an input of "001" may be mapped to a pixel value of "01", an input of "011" may be mapped to a pixel value of "10", and an input of "111" may be mapped to a pixel value of "11". However, any pixel value may be mapped to each possible set of input bits.

To compute a selector parameter 219-A for the first bit plane (i.e., for the low-order bits), we use the rightmost column of the output table 1512. Selector parameter 219-A is an eight-bit value. According to the rightmost column, a value of "0" is mapped to an input of "000" (decimal value 0), so bit zero of the selector parameter 219-A is set to "0". A value of "1" is mapped to an input of "001" (decimal value 1), so bit one of the selector parameter 219-A is set to "1". A value of "0" is mapped to an input of "011" (decimal value 3), so bit three of the selector parameter 219-A is set to "0". A value of "1" is mapped to an input of "111" (decimal value 7), so bit seven of the selector parameter 219-A is set to "1". The other bits of the selector parameter 219-A are set to a "don't care" value ("X"). Since the corresponding input bit patterns do not occur in well-designed halftone threshold arrays, these values will have no effect on the halftoned image. They may be thought of as values that will appear in the case of an error in the threshold array.

To compute a selector parameter 219-B for the second bit plane (i.e., for higher-order bits), we use leftmost column of the output table 1512. According to the leftmost column, a value of "0" is mapped to an input of "000" (decimal value 0), so bit zero of the selector parameter 219-B is set to "0". A value of "0" is mapped to an input of "001" (decimal value 1), so bit one of the selector parameter 219-B is set to "0". A value of "1" is mapped to an input of "011" (decimal value 3), so bit three of the selector parameter 219-B is set to "1". A value of "1" is mapped to an input of "111" (decimal value 7), so bit seven of the selector parameter 219-B is set to "1". The other bits of the selector parameter 219-B are set to a "don't care" value ("X").

The ternary logic operations output a set 1301 of low-order bits (LOB) for the block 800 of pixels 702, and a set 1302 of higher-order bits (HOB) for the block 800 of pixels 702. Processor 204 may repeat the multi-level halftoning process on multiple blocks of pixels 702 defined within raster image 220 in a similar manner. For example, if there is a determination (step 617) that the multi-level halftoning process is performed on additional blocks 800 of pixels 702, then method 600 returns to step 608 to identify a set of pixel values for another block 800 of pixels 702.

Processor 204 is configured to generate a plurality of bit planes 224 representing the pixel values for halftoned image 222. For example, a two-bit (four level) output includes two bit planes: one for the low-order bits, and one for the higher-order bits of each pixel. In FIG. 6B, processor 204 arranges one or more sets 1301 of the low-order bits in a first bit plane (step 618). The first bit plane therefore represents the low-order bits for the pixels of halftoned image 222. Processor 204 also arranges one or more sets 1302 of the higher-order bits in a second bit plane (step 620). The second bit plane may therefore represent the next higher-order bits for the pixels of halftoned image 222. Processor 204 may arrange one or more additional bit planes depending on the number of bits used to define pixels values in halftoned image 222.

Figure 16:
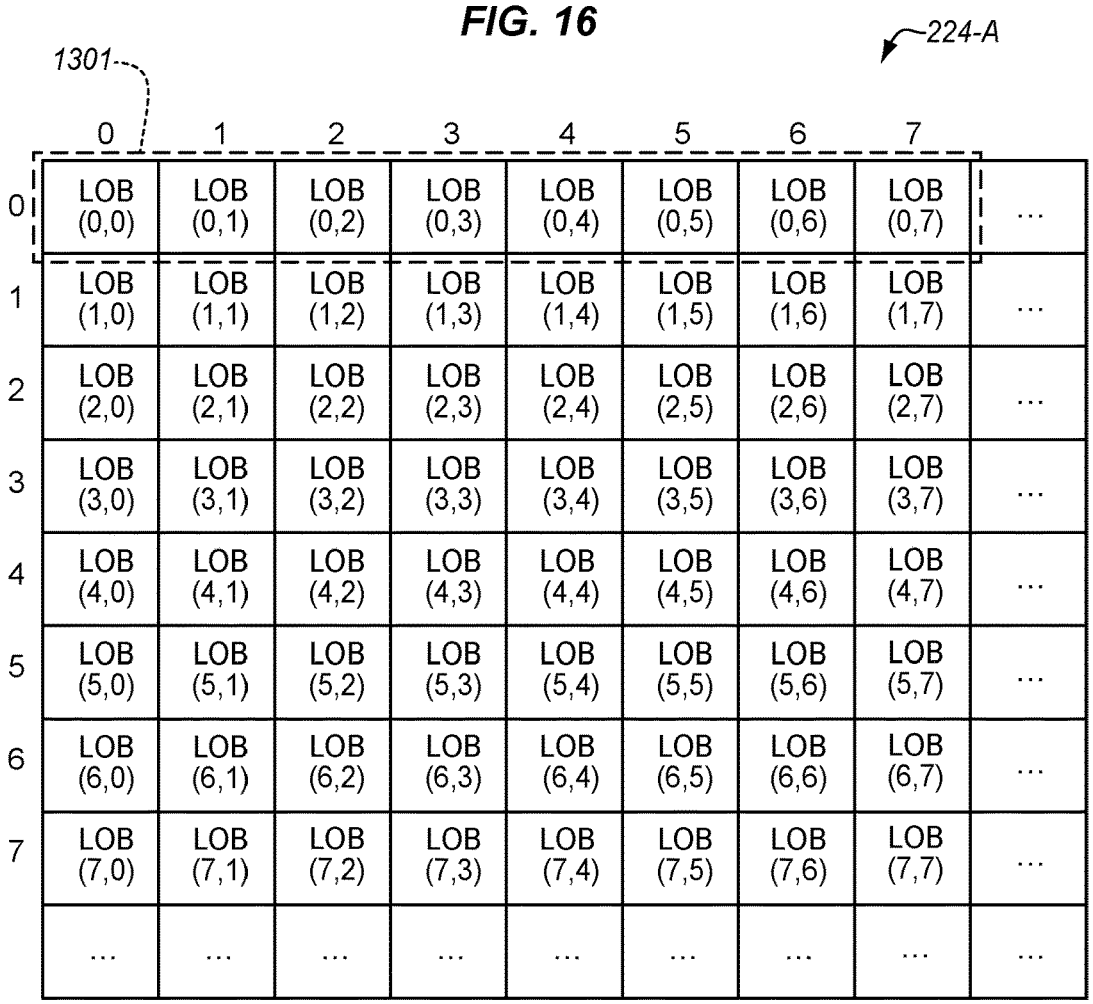

FIGS. 16-17 illustrate bit planes that define pixel values for halftoned image 222 in an illustrative embodiment. FIG. 16 illustrates the first bit plane 224-A representing the low-order bits (LOB) for one or more blocks of pixels. A bit plane is a data structure that represents one bit of a multi-bit pixel value (PV) for an array of pixels 702. When processor 204 performs the first ternary logic operation (step 614), it generates a set 1301 of low-order bits (LOB) for a block 800 of pixels 702. Processor 204 arranges the set 1301 of low-order bits in bit plane 224-A so that each of the low-order bits defines part of a pixel value for its corresponding pixel. For example, set 1301 includes the low-order bits for pixels (0,0), (0,1), (0,2), etc. The low-order bits are illustrated as being arranged in rows and columns to depict how the low-order bits correspond to pixels. However, a bit plane may have any desired structure that maps low-order bits to pixels. Processor 204 may arrange multiple sets 1301 of low-order bits in bit plane 224-A for multiple blocks 800. Thus, bit plane 224-A may include the low-order bits for pixels corresponding with a portion of a sheetside, a logical page on an N-up sheetside, a full sheetside, etc. Typically, pages to be imaged are combined into logical "sheetsides" that consist of one or more logical pages of equal length which when laid out for printing, span the width of the print web. The sheetside represents the image to be printed on a side of a sheet (or equivalent) of recording medium 132. FIG. 17 illustrates the second bit plane 224-B representing the higher-order bits (HOB) for one or more blocks of pixels. When processor 204 performs the second ternary logic operation (step 616), it generates a set 1302 of higher-order bits (HOB) for a block 800 of pixels 702. Processor 204 arranges the set 1302 of higher-order bits in bit plane 224-B so that each of the higher-order bits defines part of a pixel value for its corresponding pixel. For example, set 1302 includes higher-order bits for pixels (0,0), (0,1), (0,2), etc. Processor 204 may arrange multiple sets 1302 of higher-order bits in bit plane 224-B for multiple blocks 800. Thus, bit plane 224-B may include higher-order bits for pixels corresponding with a portion of a sheetside, a logical page on an N-up sheetside, a full sheetside, etc. In one embodiment, each bit plane 224-A/224-B may include the bits of eight pixels in a byte.

Processor 204 may be configured to output bit planes 224 to print engine 120, print mechanism 126, or another subsystem. For example, print engine 120 may be configured to handle individual bit planes for a printing operation. Thus, processor 204 may initiate transmission of the bit planes (e.g., the first bit plane 224-A and the second bit plane 224-B) to a destination, such as print engine 120, print mechanism 126, or another subsystem (step 622). For example, when halftone system 140 is implemented in print controller 114 of DFE 110 (see FIG. 1), processor 204 may access print engine interface 116 to transmit the bit planes 224 over communication link 117 to print engine 120. Print engine 120 may then initiate printing operations based on the bit planes 224. When halftone system 140 is implemented in print engine controller 124 of print engine 120, processor 204 may transmit the bit planes 224 to print mechanism 126, or to another subsystem within print engine controller 124 for further processing.

In another embodiment, processor 204 may be configured to output a halftoned image 222. In this case, processor 204 may perform an interleave operation to merge the bit planes 224 of halftoned image 222 (step 624). FIG. 18 illustrates halftoned image 222 with bit planes 224-A/224-B merged in an illustrative embodiment. Halftoned image 222 is a data structure that represents an array of pixels with multi-bit pixel values (PV). The pixel values of halftoned image 222 are y-bit values, which are less than the x-bit values used in raster image 220. The interleaving operation takes a higher-order bit (HOB) from bit plane 224-B, and a low-order bit (LOB) from bit plane 224-A to form the pixel values in halftoned image 222. Processor 204 may then initiate transmission of the halftoned image 222 to a destination, such as print engine 120, print mechanism 126, or another subsystem (step 626). For example, when halftone system 140 is implemented in print controller 114 of DFE 110 (see FIG. 1), processor 204 may access print engine interface 116 to transmit the halftoned image 222 over communication link 117 to print engine 120. Print engine 120 may then initiate printing operations based on the halftoned image 222. When halftone system 140 is implemented in print engine controller 124 of print engine 120, processor 204 may transmit the halftoned image 222 to print mechanism 126, or to another subsystem within print engine controller 124 for further processing.

The multi-level halftoning process described above is performed for a raster image 220 of a single color plane. For a CMYK color model, for example, method 600 may be repeated to halftone raster images for each of the color planes. An interleave operation as described above may also be performed on bit planes for multiple color planes. The interleaving of bits for each color plane can target the bit fields reserved for that color in a multi-color halftoned image. In this case, when the bits for each color planes are interleaved, all colors would then already be interleaved in the halftoned image.

Figure 19:
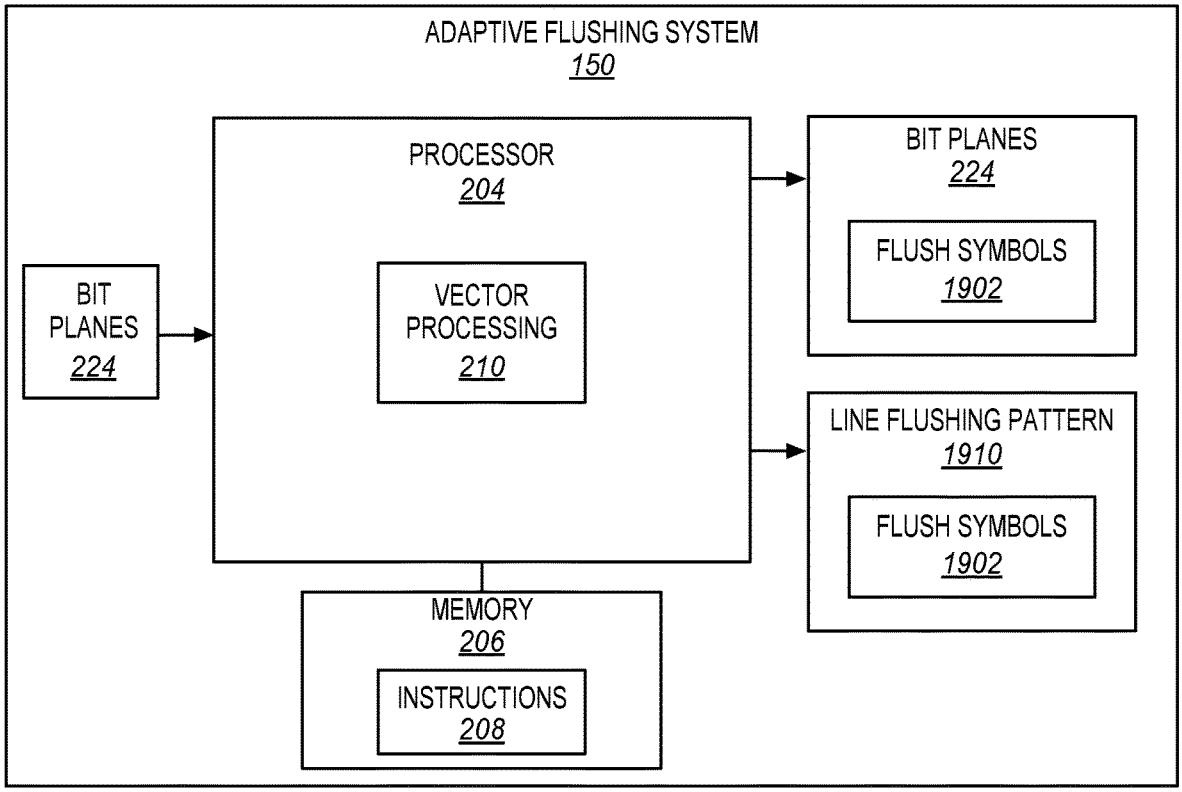
FIG. 19 is a schematic diagram of an adaptive flushing system in an illustrative embodiment.

In FIG. 1, adaptive flushing system 150 may process bit planes 224 to perform adaptive flushing. FIG. 19 is a schematic diagram of adaptive flushing system 150 in an illustrative embodiment. For this example, adaptive flushing system 150 may have a similar configuration as halftone system 140, with one or more processors 204 and a memory 206. Like with halftone system 140, processor 204 may be configured for vector processing 210. As a general overview, adaptive flushing ensures that each nozzle jets (e.g., emits ink) at least once in any given block of V rows or lines of pixels on average, and it may also guarantee a maximum number of rows/lines between jetting is not exceeded. The average flushing period V and maximum flushing period may be determined by ink and nozzle properties, as well as paper speed. When V is equal to or larger than a sheet size and space is available for flushing between printed sheets, line flushing may be used. Otherwise, star flushing may be used. Processor 204 receives bit planes 224 as input, and modifies one or more of the bit planes 224 to insert flush symbols 1902. The flush symbols 1902 inserted in bit planes 224 may be used for "star flushing". In another embodiment, processor 204 may process bit planes 224 to generate a line flushing pattern 1910 that includes flush symbols 1902 for "line flushing".

Figure 20:
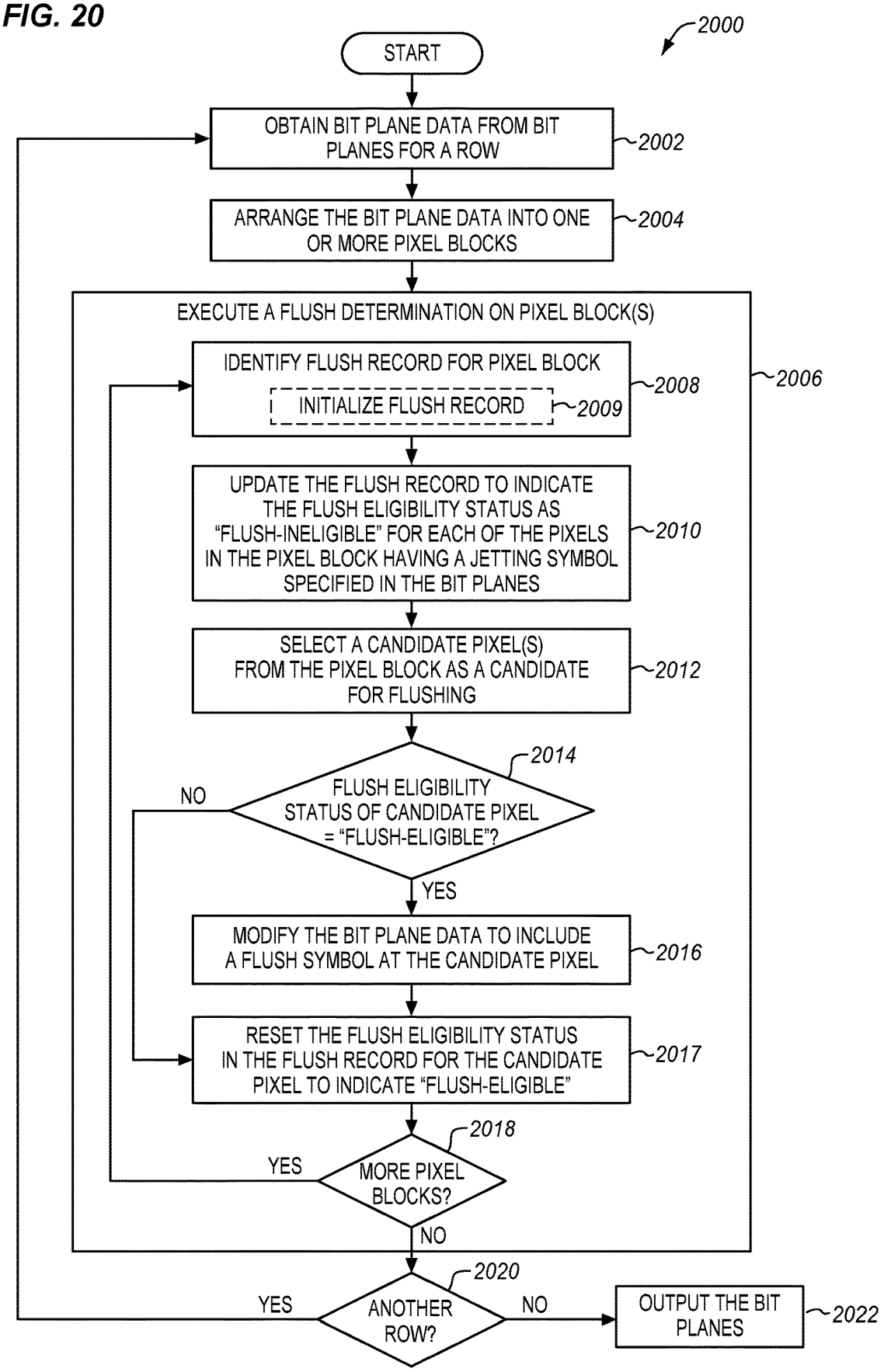
FIG. 20 is a flowchart illustrating a method of adaptive flushing in an illustrative embodiment.

FIG. 20 is a flowchart illustrating a method 2000 of adaptive flushing in an illustrative embodiment. The steps of method 2000 are described with reference to adaptive flushing system 150 in FIG. 19, but those skilled in the art will appreciate that method 2000 may be performed with other systems.

Figure 21:
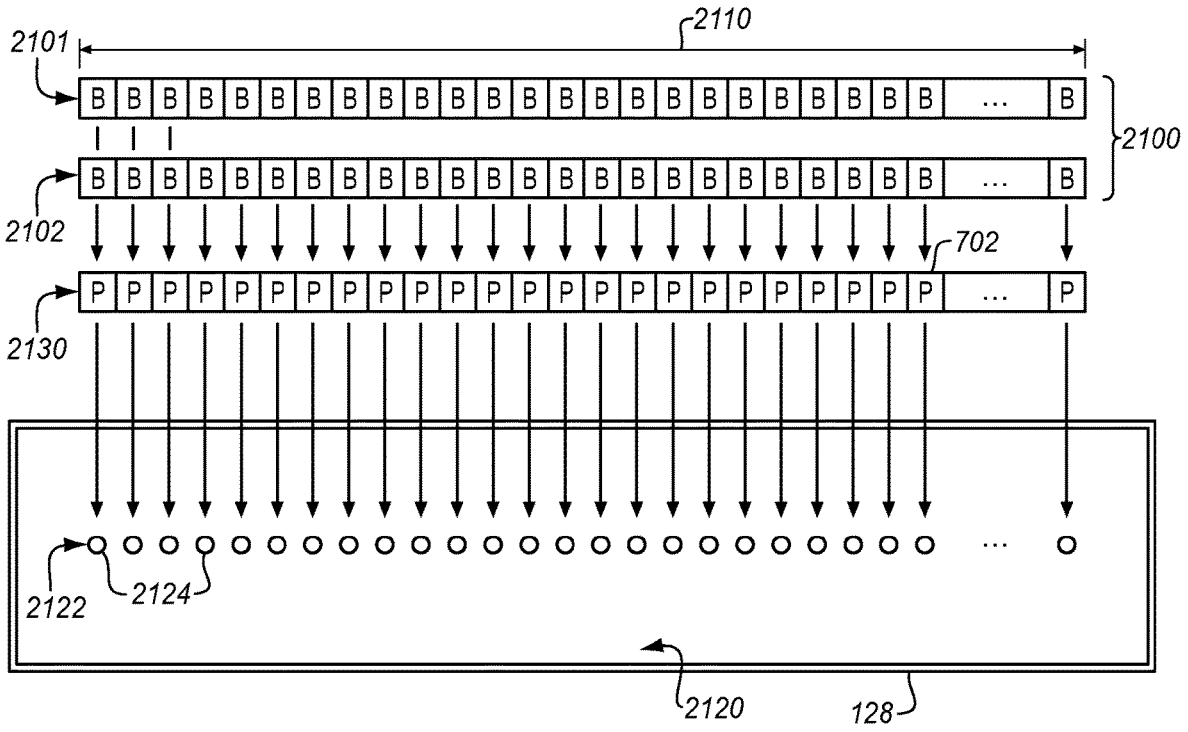
FIG. 21 illustrates bit plane data comprised of rows of bits from bit planes in an illustrative embodiment.

Method 2000 operates on rows of data from bit planes 224. Thus, processor 204 obtains bit plane data from bit planes 224 (step 2002). The bit plane data may be from bit planes 224 received from halftone system 140 as described above, or may be from bit planes received from another source. FIG. 21 illustrates bit plane data 2100 comprised of rows 2101-2102 of bits from bit planes 224 in an illustrative embodiment. For example, row 2101 may be from a first bit plane (e.g., bit plane 224-A in FIG. 16), and row 2102 may be from a second bit plane (e.g., bit plane 224-B in FIG. 17). Each row 2101-2102 includes a sequence of bits (B) along a width 2110 of a digital image, and each bit defines part of a pixel value for a pixel along a line or row of a pixel array (e.g., a digital image). Thus, FIG. 21 also illustrates a row 2130 of pixels 702 ("P") for a digital image, such as raster image 220 in FIG. 7. Each bit in rows 2101-2102 defines part of a pixel value for a corresponding pixel 702 in row 2130. For example, bits in row 2101 may represent the low-order bits (LOB) for pixels 702, and the bits in row 2102 may represent higher-order bits (HOB) or the next significant bits for pixels 702. Thus, the bits in rows 2101-2102 each correspond with one pixel 702 of a pixel array so that the position of the bits corresponds with a pixel position or pixel coordinate (x,y). Although two bit planes 224 are discussed above, there may be more than two bit planes depending on the size of the pixel values.

Also, the bits in rows 2101-2102 and the pixels 702 in row 2130 each correspond with a nozzle on a printhead 128. FIG. 21 also illustrates the nozzle surface 2120 of a printhead 128. The nozzle surface 2120 of printhead 128 includes a row 2122 of nozzles 2124, and each of the nozzles 2124 is configured to jet a recording material 134 for a pixel. Although one row 2122 of nozzles 2124 is shown in FIG. 21, there may be multiple rows 2122 of nozzles 2124 in other examples. As is evident in this example, when a bit in one or both of rows 2101-2102 includes a jetting symbol (e.g., bit value="1") for a pixel 702, the jetting symbol will cause jetting from a corresponding nozzle 2124. When neither bit in rows 2101-2102 includes a jetting symbol (e.g., bit values="0") for a pixel 702, the corresponding nozzle 2124 will be idle (non-jetting). For method 2000, one or more of the idle nozzles 2124 may be selected for flushing. More particularly, a bit in row 2101 and/or row 2102 may be modified to add a flush symbol (e.g., bit value="1") for one or more of the pixels 702 in row 2130. A flush symbol is similar to a jetting symbol in that it causes jetting from a nozzle 2124, but the flush symbol is not part of the original raster or halftoned image represented by the bit planes 224. The flush symbol is added to one or more of the bit planes 224 as part of the adaptive flushing process (e.g., star-flushing).

Figure 22:
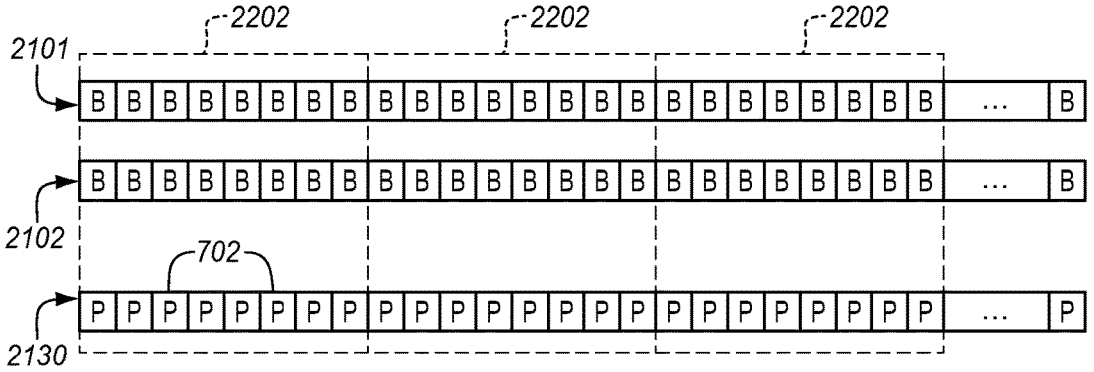
FIG. 22 illustrates rows of bits arranged into pixel blocks in an illustrative embodiment.

In FIG. 20, processor 204 is configured to arrange the bit plane data 2100 into one or more pixel blocks (step 2004). FIG. 22 illustrates rows 2101-2102 of bits arranged into pixel blocks 2202 in an illustrative embodiment. A pixel block 2202 comprises a set of consecutive pixels 702 along a row 2130 or line of a pixel array. The left-most pixel block 2202 includes the bits from rows 2101-2102 for the first eight pixels 702 along row 2130, the next pixel block 2202 includes the bits from rows 2101-2102 for the next eight pixels 702 along row 2130, etc. The size of pixel blocks 2202 is provided only as an example, as the actual size may depend on the resources of processor 204.

Figure 23:
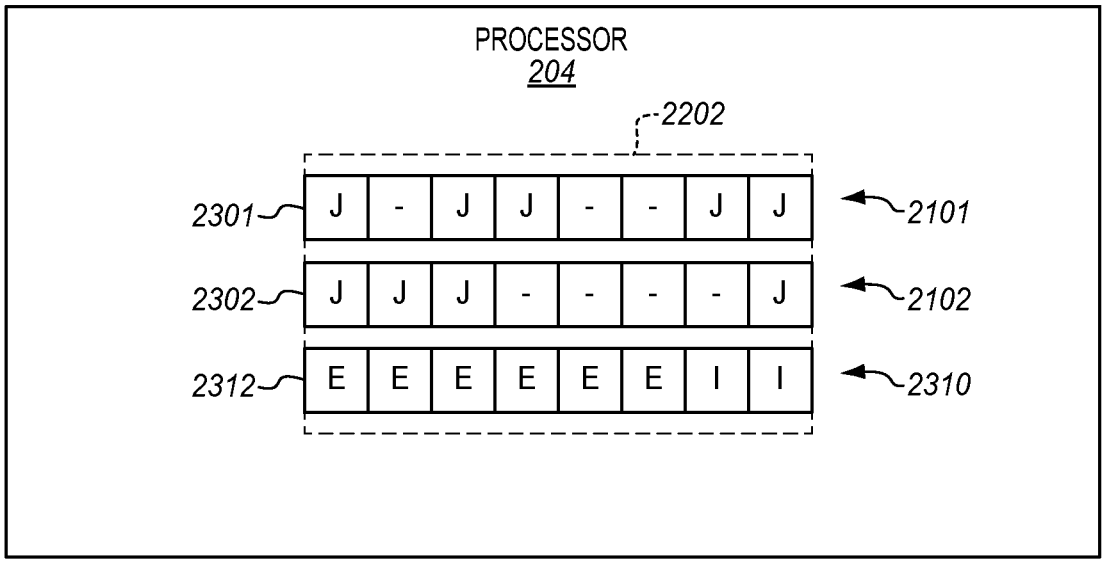
FIG. 23 is a schematic diagram of a processor with bits of a pixel block loaded in local memory in an illustrative embodiment.

In FIG. 20, processor 204 is configured to execute a flush determination on the pixel block(s) 2202 (step 2006). The flush determination is used to decide which, if any, pixels in a row 2130 are eligible for flushing. Processor 204 may therefore load the bits for a pixel block 2202 into a register, buffer, or other local memory. FIG. 23 is a schematic diagram of processor 204 with bits of a pixel block 2202 loaded in local memory in an illustrative embodiment. For this pixel block 2202, processor 204 loads a set 2301 of bits from row 2101 of a first bit plane, and a set 2302 of bits from row 2102 of a second bit plane, such as in local memory. Each of the bits in pixel block 2202 is mapped to a pixel 702 in row 2130. For example, the first bit in pixel block 2202 may be mapped to the first pixel 702 in row 2130, the second bit in pixel block 2202 may be mapped to the second pixel 702 in row 2130, etc. Each of the bits has a pixel value of "J" to indicate a jetting symbol, or "-" to indicate the absence of a jetting symbol. For example, a "J" may be a bit value of "1", and "-" may be a bit value of "0".

In FIG. 20, processor 204 identifies a flush record for the pixel block 2202 (step 2008). A flush record is a set of bits that indicate a flush eligibility status for each of the pixels 702 in the pixel block 2202. The number of bits in a flush record corresponds with the number of pixels 702 in a pixel block 2202. Processor 204 may load the flush record into a register, buffer, or other local memory. FIG. 23 also illustrates a flush record 2310 loaded for the pixel block 2202, such as in local memory. Flush record 2310 comprises a set 2312 of flush eligibility bits each specifying a flush eligibility status for its corresponding pixel 702. The flush eligibility status may be "flush-eligible", meaning that the corresponding pixel 702 is eligible for a flush symbol, or "flush-ineligible", meaning that the corresponding pixel 702 is not eligible for a flush symbol. Each of the bits in flush record 2310 has a pixel value of "E" to indicate "flush-eligible", or "I" to indicate "flush-ineligible".

Figure 24:
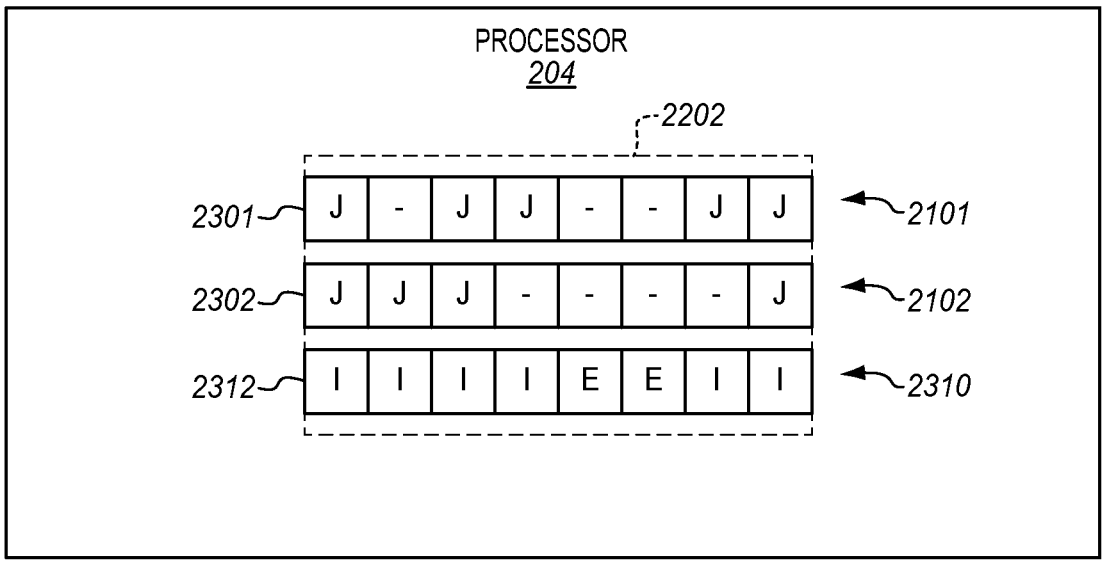
FIG. 24 is a schematic diagram of a processor with a flush record updated in an illustrative embodiment.

In FIG. 20, processor 204 may initialize flush record 2310 for this pixel block 2202 so that the flush eligibility status of each of the pixels is "flush-eligible" (step 2009 of FIG. 20). This initialization may occur when obtaining the first row of bits from bit planes 224. For each successive row that is processed according to method 2000, the state of the flush record 2310 for pixel block 2202 may change based on the data in the bit planes 224. Thus, for the present row, processor 204 updates flush record 2310 to indicate the flush eligibility status as "flush-ineligible" for each of the pixels in pixel block 2202 having a jetting symbol specified in the bit planes 224 (step 2010). FIG. 24 is a schematic diagram of processor 204 with flush record 2310 updated in an illustrative embodiment. Processor 204 looks bitwise at the set 2301 of bits from the first bit plane, and the set 2302 of bits from the second bit plane. When either bit from sets 2301-2302 includes a jetting symbol (e.g., "J"), processor 204 updates the corresponding bit in flush record 2310 so that the flush eligibility status is set to "flush-ineligible" (i.e., "I"). When neither bit from sets 2301-2302 includes a jetting symbol, processor 204 maintains the prior flush eligibility status. As shown in FIG. 24, processor 204 has changed the status of the first four bits in flush record 2310 to "flush-ineligible" (i.e., "I"). In general, when processor 204 updates flush record 2310 in this manner, the pixels 702 in the pixel block 2202 that are designated for jetting according to the bit planes 224 are marked as not eligible for flushing, as flushing would not be needed at a corresponding nozzle 2124 due to the jetting specified in the bit planes 224. For the other pixels 702 in the pixel block 2202 that are not designated for jetting according to the bit planes 224, the corresponding nozzles 2124 will be idle and may be eligible for flushing.

Figure 25:
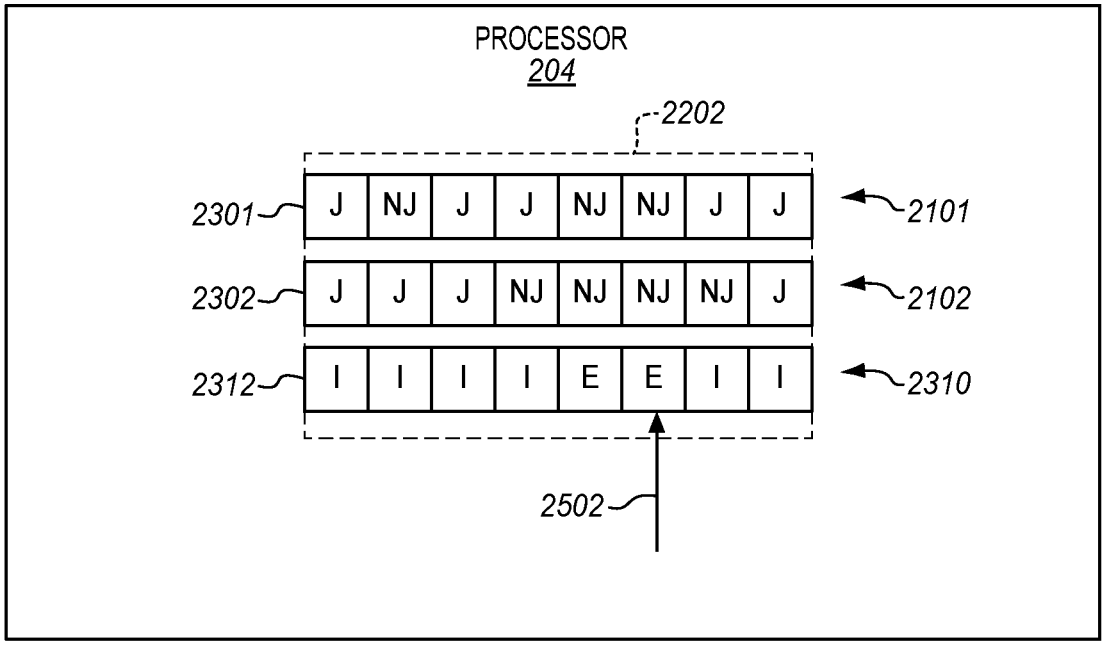
FIG. 25 is a schematic diagram of a processor selecting a candidate pixel in an illustrative embodiment.
Figure 26:
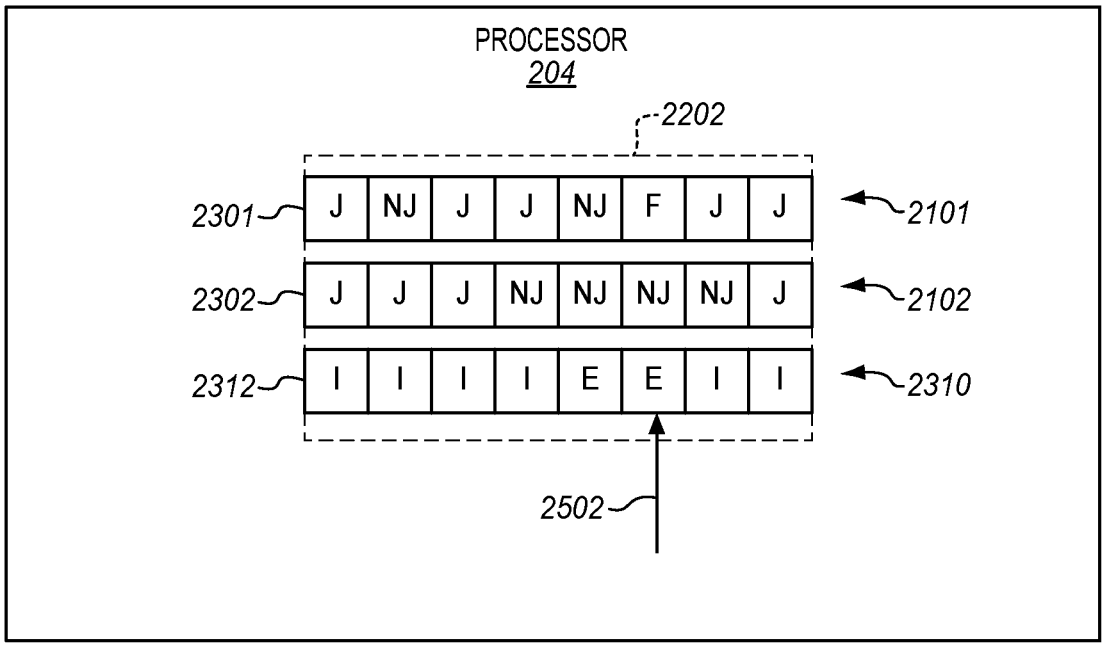
FIG. 26 is a schematic diagram of a processor modifying bit plane data in an illustrative embodiment.

At this point, flush record 2310 indicates which of the pixels 702 of pixel block 2202 are flush-eligible and which are flush-ineligible. Even though some pixels 702 may be eligible for flushing according to flush record 2310, adaptive flushing inhibits flushing for some pixels 702. Thus, processor 204 may use a quasi-random or pseudo-random selection of which flush-eligible pixels are actually used for flushing in order to obscure the flushing from human visual detection on the printed output. To do so, processor 204 selects one or more candidate pixels from the pixel block 2202 as a candidate for flushing (step 2012 of FIG. 20). FIG. 25 is a schematic diagram of processor 204 selecting a candidate pixel in an illustrative embodiment. In FIG. 25, processor 204 pseudo-randomly selects a candidate pixel 2502 from among the pixels 702 in pixel block 2202. In this example, processor 204 selects the sixth bit in the pixel block 2202 as the candidate pixel 2502. One candidate pixel 2502 is shown in FIG. 25, but more than one candidate pixel 2502 may be selected according to the flushing scheme. Although a candidate pixel 2502 is pseudo-randomly selected, it may not be eligible for flushing. For example, the nozzle 2124 corresponding with the candidate pixel 2502 may have recently jetted (e.g., been instructed to jet within a recent period) due to the bit plane data 2100 (in a prior row). In FIG. 20, processor 204 determines whether the flush eligibility status of the candidate pixel 2502 is "flush-eligible" according to flush record 2310 (step 2014). When the flush eligibility status of the candidate pixel 2502 is "flush-eligible", processor 204 modifies the bit plane data 2100 in one or more of the bit planes 224 to include a flush symbol 1902 at the candidate pixel 2502 (step 2016). FIG. 26 is a schematic diagram of processor 204 modifying bit plane data 2100 in an illustrative embodiment. In this example, processor 204 changes the sixth bit in set 2301 to include a flush symbol 1902 ("F"), which may comprise changing the bit value of this bit to a "1". Although not shown, processor 204 may change the sixth bit in set 2302 to include a flush symbol 1902 ("F") in a similar manner. Due to the flush symbol 1902 being added to the bit plane(s) 224, the nozzle 2124 corresponding with this bit will jet and flush the nozzle. In FIG. 20, when the flush eligibility status of the candidate pixel 2502 is "flush-ineligible" in step 2014, processor 204 does not modify the bit plane data 2100. Processor 204 may then reset the flush eligibility status in flush record 2310 for the candidate pixel 2502 to indicate "flush-eligible" (step 2017 of FIG. 20).

In FIG. 20, processor 204 determines whether there are more pixel blocks 2202 in the present row 2130 to process (step 2018). When there are more pixel blocks 2202, method 2000 returns to step 2008. Processor 204 operates as described above on other pixel blocks 2202 of the same row 2130. It is also noted that processor 204 may operate on multiple pixel blocks 2202 of the same row 2130 concurrently.

When the pixel blocks 2202 of a row 2130 have been processed, processor 204 determines whether there is another row of pixels defined in the bit planes 224 (step 2020). If so, method 2000 returns to step 2002 to obtain bit plane data from the next row. When each of the rows has been processed from bit planes 224, processor 204 may output the bit plane data for the bit planes 224 (step 2022). It is assumed at this point that the bit planes 224 have been modified as desired to add flush symbols 1902 if needed. Thus, processor 204 may send the bit planes 224 to print mechanism 126, where printheads 128 will mark recording medium 132 based on the bit planes 224. In one embodiment, processor 204 may output partial bit planes 224 instead of complete bit planes 224. Thus, processor 204 may not wait until all rows of the bit planes 224 are processed before outputting the bit plane data of the bit planes 224 in step 2022.

Figure 27:
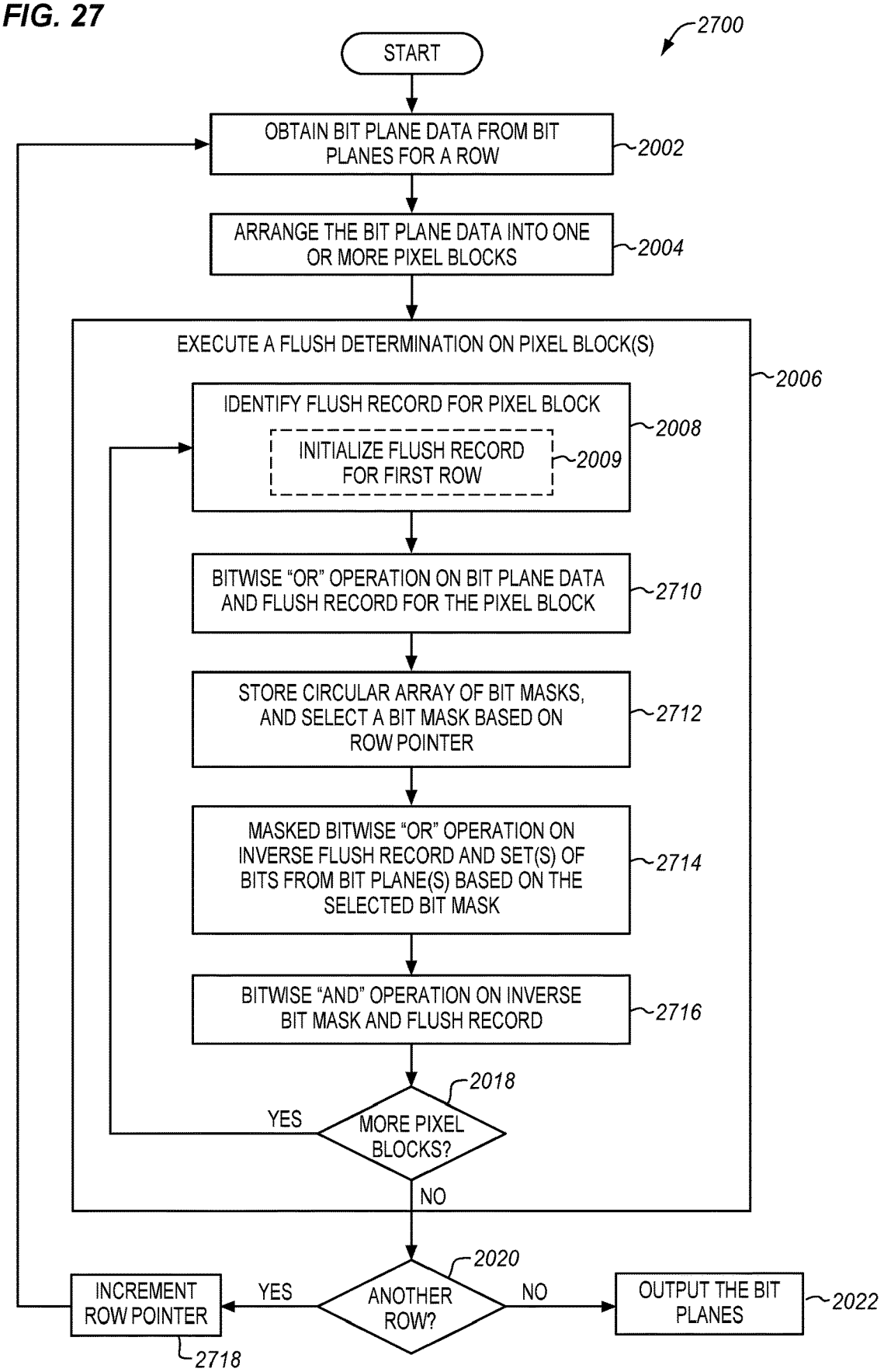
FIG. 27 is a flowchart illustrating another method of adaptive flushing in an illustrative embodiment.

FIG. 27 is a flowchart illustrating another method 2700 of adaptive flushing in an illustrative embodiment. This embodiment illustrates additional features that may be implemented into method 2000. For method 2700, processor 204 obtains bit plane data from bit planes 224 (step 2002). FIG. 28 illustrates bit planes 224 in an illustrative embodiment. In this example, two bit planes 224 are shown as bit plane 224-C (or "BP0") and bit plane 224-D (or "BP1"). The bits in bit planes 224-C and 224-D are arranged in rows 710 and columns 711 to correspond with an array of pixels 702 (see FIG. 7). Bit plane 224-C may represent the low-order bits (LOB) for pixels 702, and bit plane 224-D may represent higher-order bits (HOB) or the next significant bits for pixels 702. A bit value of "1" in bit planes 224-C and 224-D indicates a jetting symbol, which would cause a nozzle 2124 of a printhead 128 to jet at this pixel coordinate. A bit value of "0" in bit planes 224-C and 224-D does not indicate a jetting symbol. Processor 204 may obtain a single row of bit plane data from bit planes 224-C and 224-D for step 2002, or may obtain a portion or all of bit planes 224-C and 224-D that are processed row-by-row.

In FIG. 27, processor 204 arranges the bit plane data into one or more pixel blocks (step 2004). Processor 204 is configured to perform bitwise operations on pixel blocks of W bits at a time. The value of W is determined by the processing hardware (e.g., CPU or GPU). FIG. 29 illustrates pixel blocks 2202 in bit planes 224 in an illustrative embodiment. In this example, bit planes 224 are segmented into pixel blocks 2202-1, 2202-2, and 2202-3. Pixel blocks 2202-1, 2202-2, and 2202-3 are each shown as a grouping of four bits, but the size of pixel blocks 2202-1, 2202-2, and 2202-3 may depend on the resources of processor 204. It is noted that the last pixel block may be a partial block.

Figure 30:
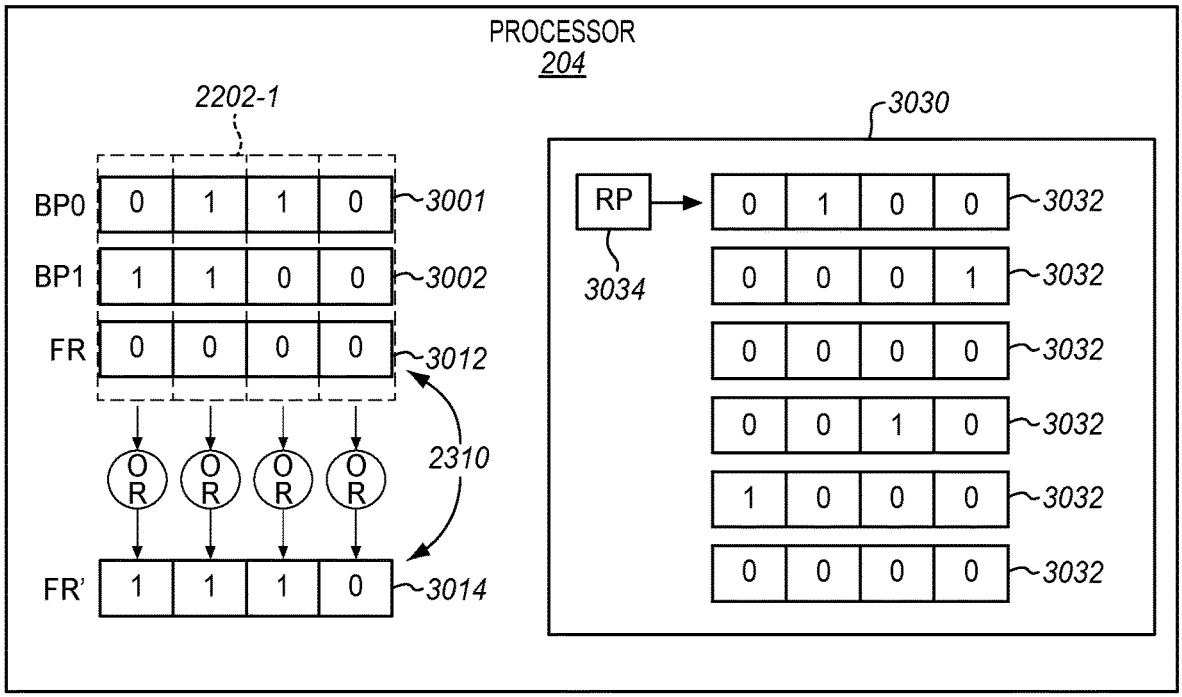
FIG. 30 is a schematic diagram of a processor with bits of pixel block loaded in local memory in an illustrative embodiment.

In FIG. 27, processor 204 is configured to execute a flush determination on the pixel block(s) 2202 (step 2006). The flush determination is performed row-by-row. Thus, processor 204 loads the bits from a row 2901 of bit planes 224-C and 224-D (for pixel block 2202-1) into a register, buffer, or other local memory. FIG. 30 is a schematic diagram of processor 204 with bits of pixel block 2202-1 loaded in local memory in an illustrative embodiment. For pixel block 2202-1, processor 204 loads a set 3001 of bits from row 2901 of bit plane 224-C (i.e., BP0) and a set 3002 of bits from the corresponding row 2901 of bit plane 224-D (i.e., BP1) in local memory. In FIG. 27, processor 204 identifies a flush record 2310 for pixel block 2202-1 (step 2008). Processor 204 may load the flush record 2310 into a register, buffer, or other local memory. For instance, FIG. 30 shows a flush record 2310 (designated also as "FR") as including an initial set 3012 of flush eligibility bits each specifying a flush eligibility status for its corresponding pixel. Flush record 2310 may be considered as "inverted", as a bit value of "1" in flush record 2310 indicates a flush eligibility status of "flush-ineligible", and a bit value of "0" in flush record 2310 indicates a flush eligibility status of "flush-eligible". The set 3012 of flush eligibility bits for flush record 2310 is considered "initial" when loaded for a particular row.

For the first row of the flush determination (e.g., the first row 2901 in bit planes 224-C and 224-D), processor 204 may initialize flush record 2310 so that each of the flush eligibility bits indicates a flush eligibility status of "flush-eligible" (step 2009 of FIG. 27). This is shown in FIG. 30 with each flush eligibility bit of flush record 2310 set to "0". Processor 204 then updates the flush record 2310 based on the data in bit planes 224-C and 224-D for pixel block 2202-1 (see step 2010 of FIG. 20). To do so, processor 204 performs a bitwise OR operation (step 2710 in FIG. 27) on the set 3001 of bits from bit plane BP0, the set 3002 of bits from bit plane BP1, and the initial set 3012 of flush eligibility bits from flush record 2310 to generate an updated set 3014 of flush eligibility bits for flush record 2310. The bitwise OR operation changes the bit values of the flush record 2310 to a "1" whenever the bit planes (BP0 or BP1) include a jetting symbol at a corresponding pixel, or the initial set 3012 of flush eligibility bits for the flush record 2310 indicate that a corresponding pixel is not eligible for flushing. For the updated flush record 2310 (shown as FR'), the updated set 3014 of flush eligibility bits shows that the first three pixels of pixel block 2202-1 are not eligible for flushing (i.e., bit value=1), and the fourth pixel of pixel block 2202-1 is eligible for flushing (i.e., bit value=0). Processor 204 may perform vector processing for the bitwise OR operation so that each of the bits in set 3001, set 3002, and set 3012 are OR' d at a time (e.g., a clock cycle).

Although some pixels may be eligible for flushing according to flush record 2310, adaptive flushing inhibits flushing for some pixels. Thus, processor 204 may use a quasi-random or pseudo-random selection of which flush-eligible pixels are actually used for flushing. To do so, processor 204 stores a circular array 3030 of bit masks 3032, and a row pointer 3034 (RP). Array 3030 has at least V rows of bit masks 3032 with W bits each. Each of the W bits in bit masks 3032 has a bit value of "1" every V row/lines. Thus, array 3030 may repeat vertically and horizontally every V row/lines, and the worst case period between jetting of each nozzle 2124 is twice the average flushing period V. Array 3030 is considered pseudo-random as the pattern of "1" bits is horizontally random, and vertically periodic. There is one row pointer 3034 for each pixel block across the width 2110 of the digital image, and the row pointers 3034 for adjacent pixel blocks may start at different rows. In other embodiments, a plurality of circular arrays 3030 may be used where at least two are not the same.

Figure 31:
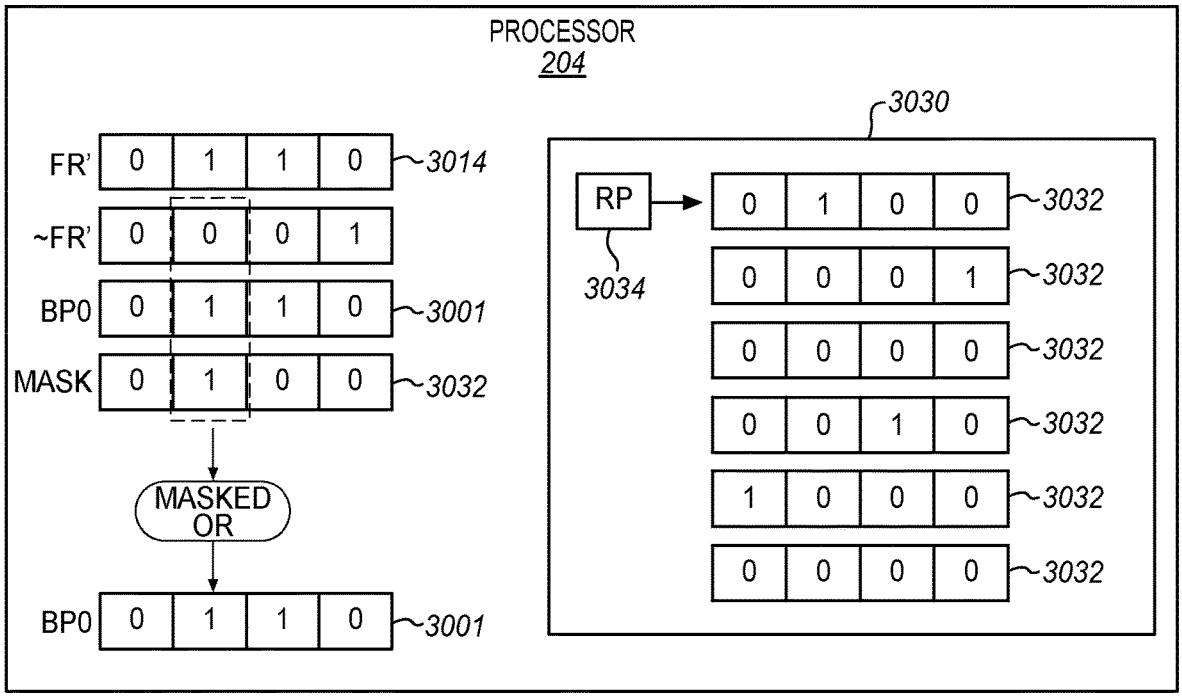
FIG. 31 is a schematic diagram of a processor with a bit mask selected in an illustrative embodiment.

Row pointer 3034 is maintained by processor 204 to select one of the bit masks 3032 from array 3030 for each row of pixels. Thus, processor 204 selects one of the bit masks 3032 for the present row 2901 of pixels based on row pointer 3034 (step 2712). FIG. 31 is a schematic diagram of processor 204 with a bit mask 3032 selected in an illustrative embodiment. Processor 204 uses the selected bit mask 3032 for a masked bitwise OR operation. Processor 204 performs the masked bitwise OR operation on the inverse flush record 2310 (~FR) and the set 3001 of bits for bit plane BP0 (step 2714 of FIG. 27). When a bit is set (i.e., bit value="1") in the selected bit mask 3032, the pixel corresponding with this bit may be a candidate for flushing. Using bit mask 3032, processor 204 performs an OR operation on the corresponding bit in the inverse flush record 2310 and the corresponding bit in set 3001 of bits for bit plane BP0. Processor 204 may perform vector processing for the masked bitwise OR operation. Based on this operation, when the corresponding bit in set 3001 of bits for bit plane BP0 is initially set to "0", this bit will be changed to a "1". This effectively adds a flush symbol to bit plane BP0. In the example shown in FIG. 31, the second bit of the selected bit mask 3032 is set, so the second bit (bit value=1) of bit plane BP0 is OR'd with the second bit (bit value=0) of the inverse flush record 2310. Because the second bit of bit plane BP0 is already set to "1", the result of the masked bitwise OR operation is that the second bit of set 3001 for bit plane BP0 is not modified. Thus, even though this bit was selected as a candidate for flushing based on the selected bit mask 3032, a flush symbol was not added to bit plane BP0 at this pixel location. Processor 204 may additionally or alternatively perform the masked bitwise OR operation on the inverse flush record 2310 (~FR) and the set 3002 of bits for bit plane BP1 (step 2714 of FIG. 27). Thus, a flush symbol 1902 may be added to either or both of bit planes BP0 and BP1.

Figure 32:
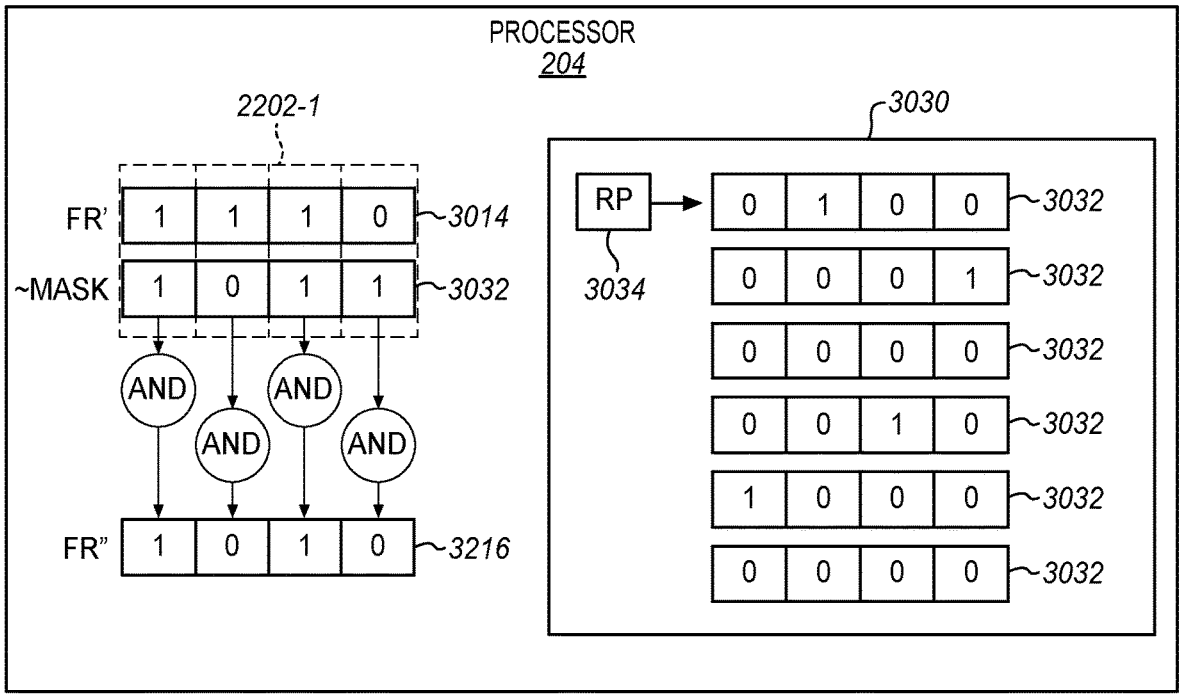
FIG. 32 is a schematic diagram of a processor resetting a flush record in an illustrative embodiment.

In FIG. 27, processor 204 may then reset the flush record 2310 for pixel block 2202-1. To do so, processor 204 performs a bitwise AND operation on the inverse of the selected bit mask 3032 and the flush record 2310 (step 2716). FIG. 32 is a schematic diagram of processor 204 resetting the flush record 2310 in an illustrative embodiment. As a reminder, flush record 2310 (shown as FR') includes an updated set 3014 of flush eligibility bits. Processor 204 performs a bitwise AND operation on the inverse of bit mask 3032 (~mask) and the updated set 3014 of flush eligibility bits for flush record 2310. The result is an adjusted set 3216 of flush eligibility bits for flush record 2310 (FR"). The flush record 2310, in the state shown in set 3216 of flush eligibility bits, is used for the next row 2902 of data for pixel block 2202-1.

Figure 33:
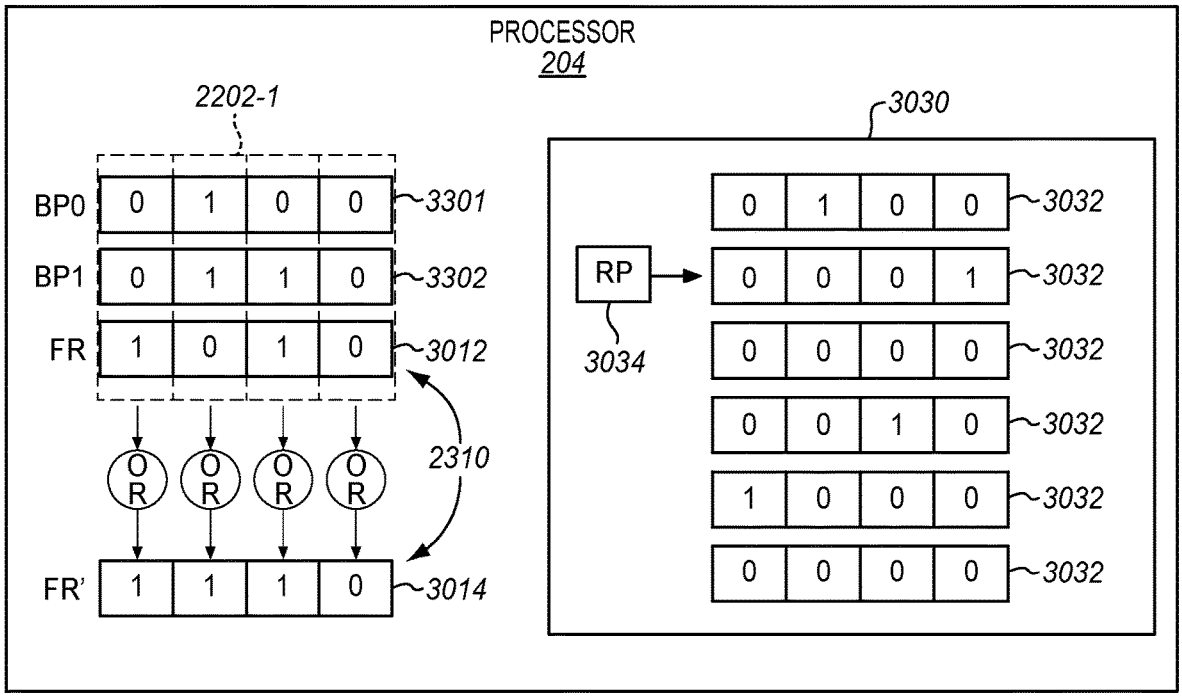
FIG. 33 is a schematic diagram of a processor with bits of a pixel block loaded in local memory in an illustrative embodiment.

In FIG. 27, processor 204 determines whether there are more pixel blocks 2202 in the present row 2901 to process (step 2018). In the example shown in FIG. 29, there are additional pixel blocks 2202-2 and 2202-3, so method 2700 would repeat for each of these pixel blocks. It is again noted that processor 204 may operate on multiple pixel blocks 2202 of the same row concurrently. When the pixel blocks 2202 of a row have been processed, processor 204 determines whether there is another row of pixels defined in the bit planes 224 (step 2020). If so, processor 204 increments the row pointer (RP) 3034 (step 2718). When the row pointer 3034 has reached the end of array 3030, it is set to zero to return to the top of array 3030. Method 2700 returns to step 2002 to obtain bit plane data from the next row (i.e., row 2902) of bit planes 224 (step 2002), and arrange the bit plane data into one or more pixel blocks (step 2004). Processor 204 loads the bits from row 2902 of bit planes 224-C and 224-D (for pixel block 2202-1) into a register, buffer, or other local memory. FIG. 33 is a schematic diagram of processor 204 with bits of pixel block 2202-1 loaded in local memory in an illustrative embodiment. For pixel block 2202-1, processor 204 loads a set 3301 of bits from row 2902 of bit plane 224-C (i.e., BP0) and a set 3302 of bits from the corresponding row 2902 of bit plane 224-D (i.e., BP1) in local memory. In FIG. 27, processor 204 identifies the flush record 2310 for pixel block 2202-1 (step 2008). FIG. 33 shows a flush record 2310 (designated also as "FR") comprising an initial set 3012 of flush eligibility bits each specifying a flush eligibility status for its corresponding pixel. Flush record 2310 was updated and reset during processing of the prior row 2901. Thus, the adjusted set 3216 of bits for flush record 2310 from row 2901 is used as the initial set 3012 of flush eligibility bits for row 2902.

In FIG. 27, processor 204 performs a bitwise OR operation (step 2710) on the set 3301 of bits from bit plane BP0, the set 3302 of bits from bit plane BP1, and the initial set 3012 of flush eligibility bits from flush record 2310 to generate an updated set 3014 of flush eligibility bits for flush record 2310. In FIG. 33, the bitwise OR operation changes the bit values of the flush record 2310 to a "1" whenever the bit planes (BP0 or BP1) include a jetting symbol at a corresponding pixel, or the initial set 3012 of flush eligibility bits for the flush record 2310 indicate that a corresponding pixel is not eligible for flushing. For the updated flush record 2310 (shown as FR'), the updated set 3014 of flush eligibility bits shows that the first three pixels of pixel block 2202-1 are not eligible for flushing (i.e., bit value=1), and the fourth pixel of pixel block 2202-1 is eligible for flushing (i.e., bit value=0).

Figure 34:
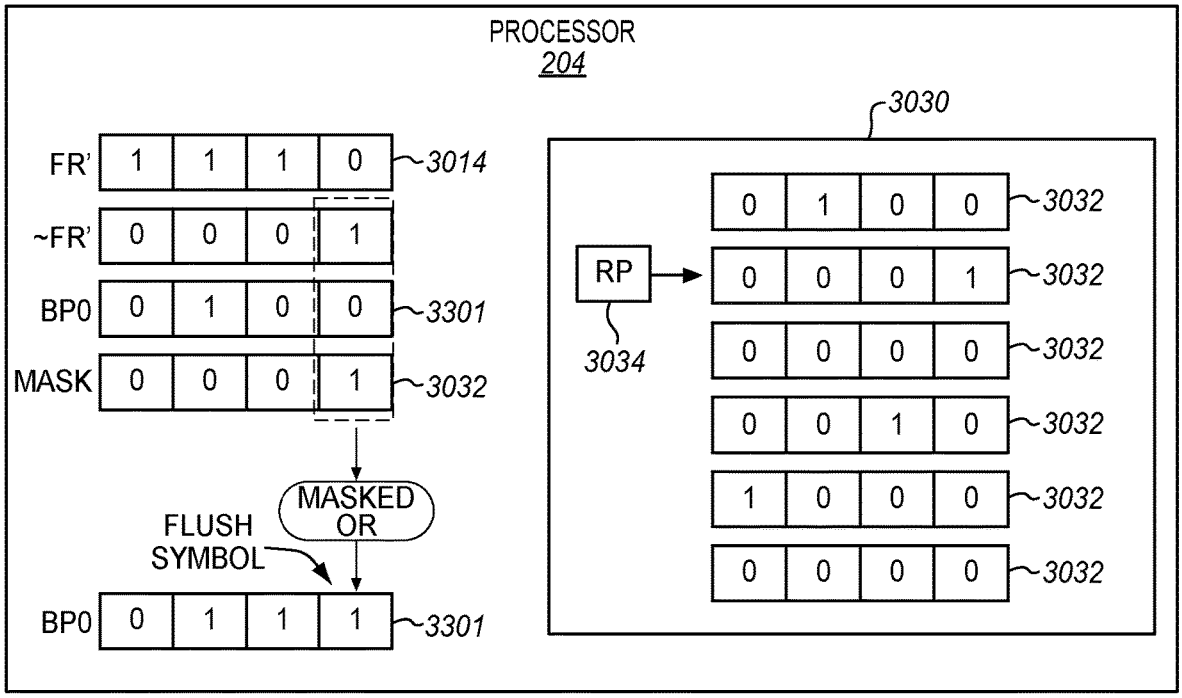
FIG. 34 is a schematic diagram of a processor with a bit mask selected in an illustrative embodiment.

In FIG. 27, processor 204 selects one of the bit masks 3032 for the present row 2902 of pixels based on row pointer 3034 (step 2712). FIG. 34 is a schematic diagram of processor 204 with a bit mask 3032 selected in an illustrative embodiment. According to row pointer 3034, the next bit mask 3032 in array 3030 is selected for row 2902, and processor 204 uses the selected bit mask 3032 for a masked bitwise OR operation. Processor 204 performs the masked bitwise OR operation on the inverse flush record 2310 (~FR) and the set 3301 of bits for bit plane BP0 (step 2714 of FIG. 27). When a bit is set (i.e., bit value="1") in the selected bit mask 3032, the pixel corresponding with this bit may be a candidate for flushing. Using bit mask 3032, processor 204 performs an OR operation on the corresponding bit in the inverse flush record 2310 and the corresponding bit in set 3301 of bits for bit plane BP0. In the example shown in FIG. 34, the fourth bit of the selected bit mask 3032 is set, so the fourth bit (bit value=1) of bit plane BP0 is OR'd with the fourth bit (bit value=1) of the inverse flush record 2310. This OR operation changes the value of this bit in bit plane BP0 to a "1", which effectively adds a flush symbol 1902 to bit plane BP0 at this bit location. Processor 204 may additionally or alternatively perform the masked bitwise OR operation on the inverse flush record 2310 (~FR) and the set 3302 of bits for bit plane BP1 (step 2714 of FIG. 27). Thus, a flush symbol 1902 may be added to either or both of bit planes BP0 and BP1.

Figure 35:
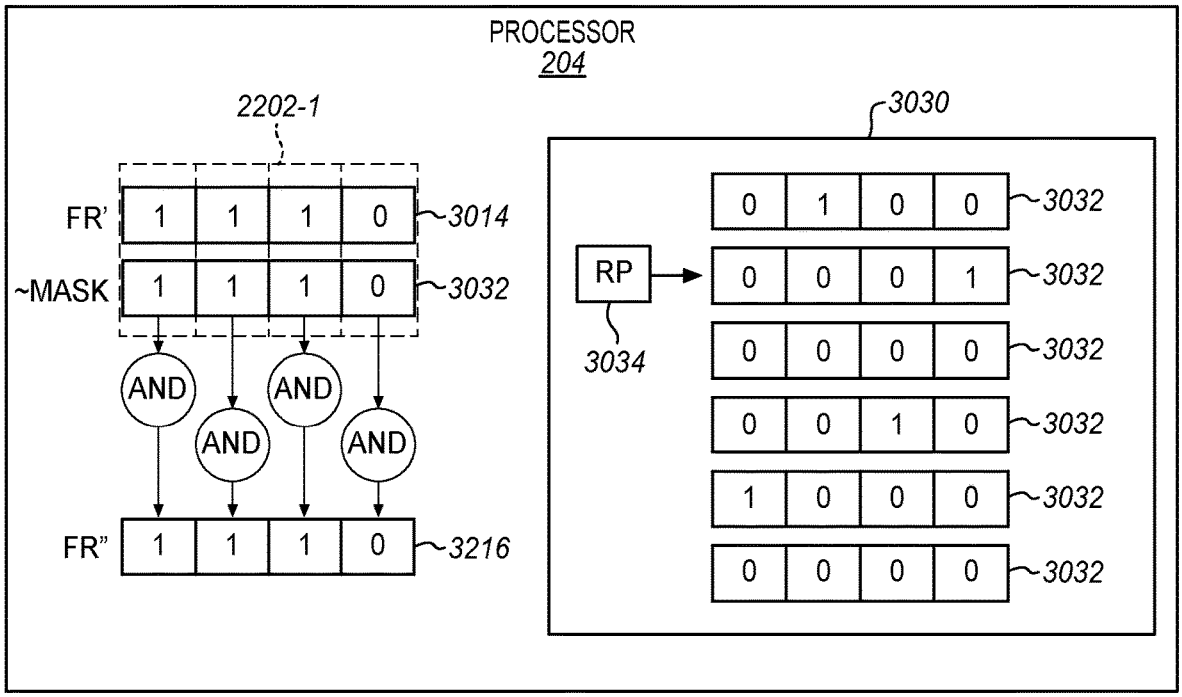
FIG. 35 is a schematic diagram of a processor resetting a flush record in an illustrative embodiment.

In FIG. 27, processor 204 may then reset the flush record 2310 for pixel block 2202-1. To do so, processor 204 performs a bitwise AND operation on the inverse of the selected bit mask 3032 and the flush record 2310 (step 2716). FIG. 35 is a schematic diagram of processor 204 resetting the flush record 2310 in an illustrative embodiment. As a reminder, flush record 2310 (shown as FR') includes an updated set 3014 of flush eligibility bits. Processor 204 performs a bitwise AND operation on the inverse of bit mask 3032 (mask) and the updated set 3014 of flush eligibility bits for flush record 2310. The result is an adjusted set 3216 of flush eligibility bits for flush record 2310 (FR"). The flush record 2310, in the state shown in the adjusted set 3216 of flush eligibility bits, is used for the next row of data for pixel block 2202-1.

In FIG. 27, processor 204 determines whether there are more pixel blocks 2202 in the present row 2902 to process (step 2018). In the example shown in FIG. 29, there are additional pixel blocks 2202-2 and 2202-3 for row 2902, so method 2700 would repeat for each of these pixel blocks. When the pixel blocks 2202 of row 2902 have been processed, processor 204 determines whether there is another row of pixels defined in the bit planes 224 (step 2020). If so, processor 204 increments the row pointer (RP) (step 2718). Method 2700 returns to step 2002 to obtain bit plane data from the next row. When each of the rows has been processed, processor 204 may output the bit plane data for the bit planes 224 (step 2022). It is assumed at this point that the bit planes 224 have been modified as desired to add flush symbols 1902 if needed. Thus, processor 204 may send the bit planes 224 to print mechanism 126, where printheads 128 will mark the recording medium 132 based on the bit planes 224.

One technical benefit of method 2700 is that bitwise operations may be performed on a block of bits at a time (e.g., in a clock cycle), or they are arithmetic operations on a single integer. Method 2700 therefore exploits SIMD capabilities of modern CPUs and GPUs. This makes adaptive flushing feasible on high speed, high resolution, wide format printers without using dedicated FPGA hardware.

Figure 36:
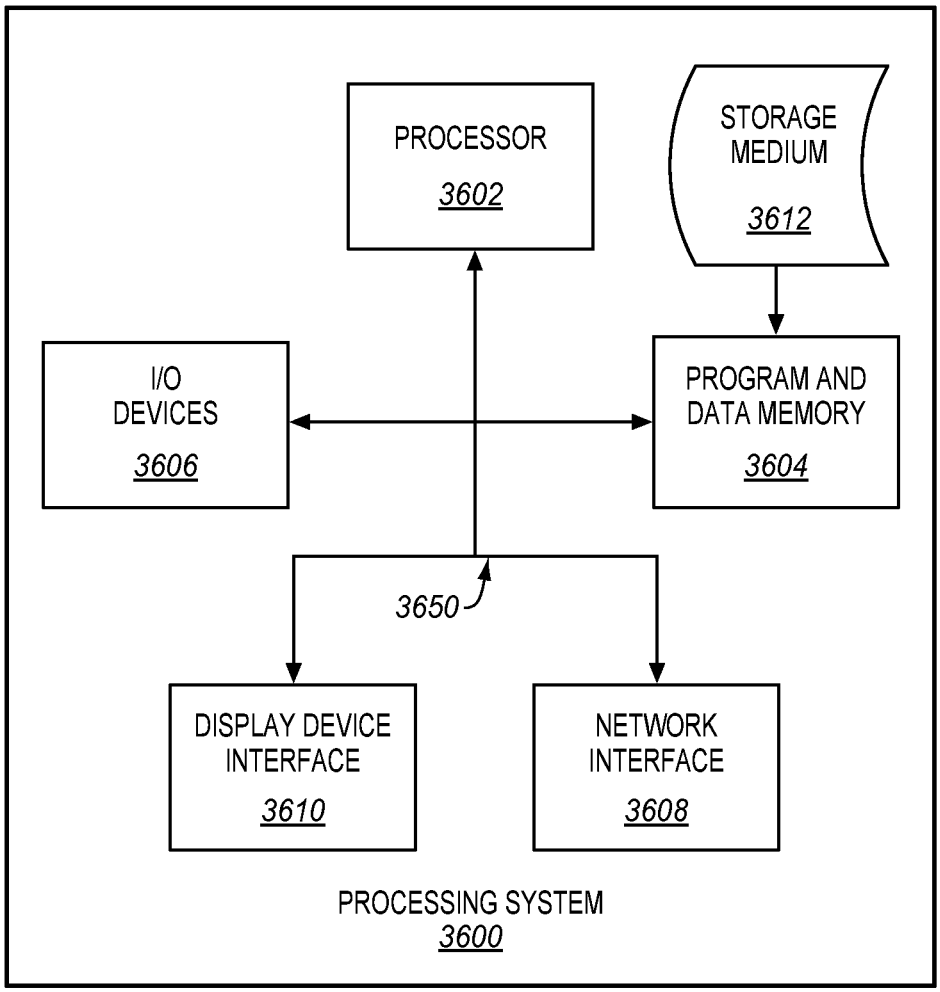
FIG. 36 illustrates a processing system operable to execute a computer readable medium embodying programmed instructions to perform desired functions in an illustrative embodiment.

Embodiments disclosed herein can take the form of software, hardware, firmware, or various combinations thereof. In one particular embodiment, software is used to direct a processing system of the image forming apparatus 100 to perform the various operations disclosed herein. FIG. 36 illustrates a processing system 3600 operable to execute a computer readable medium embodying programmed instructions to perform desired functions in an illustrative embodiment. Processing system 3600 is operable to perform the above operations by executing programmed instructions tangibly embodied on computer readable storage medium 3612. In this regard, embodiments can take the form of a computer program accessible via computer-readable medium 3612 providing program code for use by a computer or any other instruction execution system. For the purposes of this description, computer readable storage medium 3612 can be anything that can contain or store the program for use by the computer. Computer readable storage medium 3612 can be an electronic, magnetic, optical, electromagnetic, infrared, or semiconductor device. Examples of computer readable storage medium 3612 include a solid-state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD. Processing system 3600, being suitable for storing and/or executing the program code, includes at least one processor 3602 coupled to program and data memory 3604 through a system bus 3650. Program and data memory 3604 can include local memory employed during actual execution of the program code, bulk storage, and cache memories that provide temporary storage of at least some program code and/or data in order to reduce the number of times the code and/or data are retrieved from bulk storage during execution. I/O devices 3606 (including but not limited to keyboards, displays, pointing devices, etc.) can be coupled either directly or through intervening I/O controllers. Network adapter interfaces 3608 may also be integrated with the system to enable processing system 3600 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 3610 may be integrated with the system to interface to one or more display devices, such as printing systems and screens for presentation of data generated by processor 3602.

Although specific embodiments are described herein, the scope of the disclosure is not limited to those specific embodiments. The scope of the disclosure is defined by the following claims and any equivalents thereof.

What is claimed is:

1. An adaptive flushing system, comprising:
at least one processor; and
a memory including computer program code executable by the processor to cause the adaptive flushing system to:
obtain bit plane data from a plurality of bit planes that in combination define pixel values for an array of pixels, wherein the bit plane data comprises bits from each of the bit planes for a row of the pixels;
arrange the bit plane data into one or more pixel blocks;
for each pixel block of the pixel blocks:
identify a flush record for the pixel block that indicates a flush eligibility status for each of the pixels in the pixel block;
update the flush record to indicate the flush eligibility status as flush-ineligible for each of the pixels in the pixel block having a jetting symbol specified in the bit planes;
select at least one candidate pixel from the pixel block as a candidate for flushing; and
modify the bit plane data in at least one of the bit planes to include a flush symbol at the candidate pixel when the candidate pixel has a flush eligibility status that is flush eligible; and
output the bit plane data for the bit planes.

2. The adaptive flushing system of claim 1 wherein the processor further causes the adaptive flushing system to:

reset the flush eligibility status in the flush record for the candidate pixel to indicate flush-eligible.

3. The adaptive flushing system of claim 2, wherein the processor further causes the adaptive flushing system to:

process the bit plane data from each of the bit planes for a next row of the pixels using the flush record as updated and reset.

4. The adaptive flushing system of claim 2, wherein:

the flush record comprises a set of flush eligibility bits, wherein a first bit value in the set of flush eligibility bits indicates a flush eligibility status of flush-ineligible, and a second bit value in the set of flushing eligibility bits indicates a flush eligibility status of flush-eligible;

the bit planes include a first bit plane having a first set of bits for the pixel block, and a second bit plane having a second set of bits for the pixel block, wherein the first bit value in the first set of bits and the second set of bits indicates a jetting symbol, and the second bit value in the first set of bits and the second set of bits does not indicate a jetting symbol; and to update the flush record, the processor further causes the adaptive flushing system to perform a bitwise OR operation on the first set of bits, the second set of bits, and the set of flush eligibility bits to generate an updated set of flush eligibility bits for the flush record.

5. The adaptive flushing system of claim 4, wherein to select at least one candidate pixel from the pixel block as a candidate for flushing, the processor further causes the adaptive flushing system to:

store a circular array of bit masks; and select one of the bit masks to apply to the pixel block for the row of the pixels, wherein bit values of the selected one of the bit masks indicate the at least one of the candidate pixels for flushing.

6. The adaptive flushing system of claim 5, wherein:

the circular array includes V rows of the bit masks having W bits each;

each of the W bits in the bit masks has a bit value of "1" every V row; and the circular array of bit masks repeats vertically and horizontally every V rows of pixels.

7. The adaptive flushing system of claim 5, wherein the processor further causes the adaptive flushing system to:

perform at least one of:

a masked bitwise OR operation using the selected one of the bit masks on an inverse of the updated set of flush eligibility bits and the first set of bits from the first bit plane to modify the first set of bits; and a masked bitwise OR operation using the selected one of the bit masks on an inverse of the updated set of flush eligibility bits and the second set of bits from the second bit plane to modify the second set of bits.

8. The adaptive flushing system of claim 7, wherein the processor further causes the adaptive flushing system to:

perform a bitwise AND operation on an inverse of the selected one of the bit masks and the updated set of flush eligibility bits to reset the flush eligibility status in the flush record for the candidate pixel.

9. An image forming apparatus comprising:

the adaptive flushing system of claim 1.

10. A method of adaptive flushing, the method comprising:

obtaining bit plane data from a plurality of bit planes that in combination define pixel values for an array of pixels, wherein the bit plane data comprises bits from each of the bit planes for a row of the pixels;

arranging the bit plane data into one or more pixel blocks;

for each pixel block of the pixel blocks:

identifying a flush record for the pixel block that indicates a flush eligibility status for each of the pixels in the pixel block;

updating the flush record to indicate the flush eligibility status as flush-ineligible for each of the pixels in the pixel block having a jetting symbol specified in the bit planes;

selecting at least one candidate pixel from the pixel block as a candidate for flushing; and modifying the bit plane data in at least one of the bit planes to include a flush symbol at the candidate pixel when the candidate pixel has a flush eligibility status that is flush eligible; and outputting the bit plane data for the bit planes.

11. The method of claim 10 further comprising:

resetting the flush eligibility status in the flush record for the candidate pixel to indicate flush-eligible.

12. The method of claim 11, wherein:

the flush record comprises a set of flush eligibility bits, wherein a first bit value in the set of flush eligibility bits indicates a flush eligibility status of flush-ineligible, and a second bit value in the set of flushing eligibility bits indicates a flush eligibility status of flush-eligible;

the bit planes include a first bit plane having a first set of bits for the pixel block, and a second bit plane having a second set of bits for the pixel block, wherein the first bit value in the first set of bits and the second set of bits indicates a jetting symbol, and the second bit value in the first set of bits and the second set of bits does not indicate a jetting symbol; and updating the flush record comprises performing a bitwise OR operation on the first set of bits, the second set of bits, and the set of flush eligibility bits to generate an updated set of flush eligibility bits for the flush record.

13. The method of claim 12, wherein selecting at least one candidate pixel from the pixel block as a candidate for flushing comprises:

storing a circular array of bit masks; and selecting one of the bit masks to apply to the pixel block for the row of the pixels, wherein bit values of the selected one of the bit masks indicate the at least one of the candidate pixels for flushing.

14. The method of claim 13, wherein modifying the bit plane data in at least one of the bit planes comprises:

performing at least one of:

a masked bitwise OR operation using the selected one of the bit masks on an inverse of the updated set of flush eligibility bits and the first set of bits from the first bit plane to modify the first set of bits; and a masked bitwise OR operation using the selected one of the bit masks on an inverse of the updated set of flush eligibility bits and the second set of bits from the second bit plane to modify the second set of bits.

15. The method of claim 14, wherein resetting the flush eligibility status in the flush record for the candidate pixel comprises:

performing a bitwise AND operation on an inverse of the selected one of the bit masks and the updated set of flush eligibility bits.

16. A non-transitory computer readable medium embodying programmed instructions which, when executed by a processor, are operable for performing a method of adaptive flushing, the method comprising:

obtaining bit plane data from a plurality of bit planes that in combination define pixel values for an array of pixels, wherein the bit plane data comprises bits from each of the bit planes for a row of the pixels;

arranging the bit plane data into one or more pixel blocks;

for each pixel block of the pixel blocks:

identifying a flush record for the pixel block that indicates a flush eligibility status for each of the pixels in the pixel block;

updating the flush record to indicate the flush eligibility status as flush-ineligible for each of the pixels in the pixel block having a jetting symbol specified in the bit planes;

selecting at least one candidate pixel from the pixel block as a candidate for flushing; and modifying the bit plane data in at least one of the bit planes to include a flush symbol at the candidate pixel when the candidate pixel has a flush eligibility status that is flush eligible; and outputting the bit plane data for the bit planes.

17. The computer readable medium of claim 16, wherein:

the flush record comprises a set of flush eligibility bits, wherein a first bit value in the set of flush eligibility bits indicates a flush eligibility status of flush-ineligible, and a second bit value in the set of flushing eligibility bits indicates a flush eligibility status of flush-eligible;

the bit planes include a first bit plane having a first set of bits for the pixel block, and a second bit plane having a second set of bits for the pixel block, wherein the first bit value in the first set of bits and the second set of bits indicates a jetting symbol, and the second bit value in the first set of bits and the second set of bits does not indicate a jetting symbol; and updating the flush record comprises performing a bitwise OR operation on the first set of bits, the second set of bits, and the set of flush eligibility bits to generate an updated set of flush eligibility bits for the flush record.

18. The computer readable medium of claim 17, wherein selecting at least one candidate pixel from the pixel block as a candidate for flushing comprises:

storing a circular array of bit masks; and selecting one of the bit masks to apply to the pixel block for the row of the pixels, wherein bit values of the selected one of the bit masks indicate the at least one of the candidate pixels for flushing.

19. The computer readable medium of claim 18, wherein modifying the bit plane data in at least one of the bit planes comprises:

performing at least one of:

a masked bitwise OR operation using the selected one of the bit masks on an inverse of the updated set of flush eligibility bits and the first set of bits from the first bit plane to modify the first set of bits; and a masked bitwise OR operation using the selected one of the bit masks on an inverse of the updated set of flush eligibility bits and the second set of bits from the second bit plane to modify the second set of bits.

20. The computer readable medium of claim 19, wherein the method further comprises:

performing a bitwise AND operation on an inverse of the selected one of the bit masks and the updated set of flush eligibility bits to reset the flush eligibility status in the flush record for the candidate pixel.

* * * * *